US012427371B2

(12) United States Patent
Lin

(10) Patent No.: US 12,427,371 B2
(45) **Date of Patent: *Sep. 30, 2025**

(54) TRANSMISSION STRUCTURE FOR CHANGING SLIDING DIRECTION OF A CLIMBER APPARATUS

(71) Applicant: Chih-Yung Hsu, Tainan (TW)

(72) Inventor: Tsung-Chou Lin, Tainan (TW)

(73) Assignee: Chih-Yung Hsu, Tainan (TW)

( * ) Notice: Subject to any disclaimer, the term of this patent is extended or adjusted under 35 U.S.C. 154(b) by 276 days.

This patent is subject to a terminal disclaimer.

(21) Appl. No.: 18/170,360

(22) Filed: Feb. 16, 2023

(65) Prior Publication Data

US 2023/0256294 A1 Aug. 17, 2023

(30) Foreign Application Priority Data

Feb. 17, 2022 (TW) ..... 111201661

(51) Int. Cl.
*A63B 23/035* (2006.01)
*A63B 21/00* (2006.01)
*A63B 22/00* (2006.01)

(52) U.S. Cl.
CPC .... *A63B 23/03583* (2013.01); *A63B 21/4034* (2015.10); *A63B 21/4035* (2015.10); *A63B 21/4045* (2015.10); *A63B 22/0012* (2013.01); *A63B 22/0069* (2013.01); *A63B 23/03591* (2013.01); *A63B 2022/0092* (2013.01)

(58) Field of Classification Search
CPC ..... A63B 21/4034; A63B 21/4035; A63B 21/4045; A63B 22/0012; A63B 22/0023; A63B 22/0069; A63B 22/205; A63B 22/001; A63B 23/03583; A63B 23/03591; A63B 2022/0092
See application file for complete search history.

(56) References Cited

U.S. PATENT DOCUMENTS

| | | | | |
|---|---|---|---|---|
| 11,235,197 | B2 * | 2/2022 | Carruthers | A63B 22/04 |
| 12,005,307 | B1 * | 6/2024 | Maresh | A63B 21/154 |
| 12,042,690 | B2 * | 7/2024 | Hsu | A63B 21/154 |
| 12,053,663 | B2 * | 8/2024 | Lin | A63B 21/154 |

(Continued)

FOREIGN PATENT DOCUMENTS

| | | |
|---|---|---|
| TW | I656899 B | 4/2019 |
| TW | M578599 U | 6/2019 |

*Primary Examiner* — Megan Anderson
(74) *Attorney, Agent, or Firm* — Muncy, Geissler, Olds & Lowe, P.C.

(57) ABSTRACT

The present invention relates to a transmission structure for changing sliding direction of a climber apparatus, which enables an operator to operate the apparatus in an upright position. The transmission structure includes: a base, a support, a first slide rail, a second slide rail, a first transmission unit, a second transmission unit, a first handle slider, a first footplate slider, a second handle slider, and a second footplate slider. During manufacture and assembly, the first handle slider, the first footplate slider, the second handle slider, and the second footplate slider are able to be respectively connected to a first drive member or a second drive member at different selected positions. Under the prerequisite that the left foot and right foot of the operator carry out alternate reverse treading throughout the exercise routine, different training modes can be selected.

9 Claims, 21 Drawing Sheets

(56) References Cited

U.S. PATENT DOCUMENTS

| | | | | |
|---|---|---|---|---|
| 12,053,666 | B2 * | 8/2024 | Hsu | A63B 21/00192 |
| 12,226,669 | B2 * | 2/2025 | Hsu | A63B 22/001 |
| 2022/0395735 | A1 * | 12/2022 | Sun | A63B 22/0005 |

* cited by examiner

TRANSMISSION STRUCTURE FOR CHANGING SLIDING DIRECTION OF A CLIMBER APPARATUS

BACKGROUND OF THE INVENTION

(a) Field of the Invention

The present invention relates to a transmission structure that can be selectively assembled for different training modes during production and manufacture of a climber apparatus.

(b) Description of the Prior Art

Due to the restrictions of outdoor locations and climate, and in order to improve the established practice of indoor exercise and fitness culture, climber apparatuses that can simulate the dynamics of rock climbing and mountaineering are used to effectively practice the synchronized and coordinated movement of the hands and feet necessary for such sports, and efficiently achieve an exercise and fitness effect.

Structures of climber apparatuses of the prior art include Taiwan Patent No. 1656899, issued on Apr. 21, 2019, which discloses a rock climbing apparatus comprising a resistance force device, a drive device, and two climbing devices, wherein the drive device comprises an upper wheel set, an axial wheel set, and a lower wheel set. The axial wheel set comprises a first axial wheel and a second axial wheel. Upward and downward motion of the climbing devices drives the upper wheel set and the lower wheel set through a plurality of connecting members to affect a first directional rotation. The upper wheel set drives the first axial wheel to affect a second directional rotation, and the lower wheel set drives the second axial wheel to affect a first directional rotation.

Further, Taiwan Patent No. M578599, issued on Jun. 1, 2019, discloses an adjustable angle rock climbing stretching apparatus, comprising a frame unit, a sliding rod unit, a resistance unit, and a lifting frame unit. The frame unit comprises a bottom frame assembly, suitable for placement on a mounting surface, and an upright frame assembly mounted on the bottom frame assembly at an angle to the mounting surface. The sliding rod unit comprises two sliding rods and two handles respectively configured to the sliding rods, and two footplates respectively configured to the sliding rods. The resistance unit is mounted on the frame unit and provides a resistance force when the footplates are in motion. The lifting frame unit is provided with a first end portion configured to the frame unit and a second end portion that can be placed on the mounting surface. The lifting frame unit can be operated to change the distance between the first end portion and the second end portion, and can further adjust the angle of the extended direction of the upright frame assembly to the mounting surface to meet a variety of training requirements, and achieve the effects to save on space and costs.

The training modes of these climber apparatus patents of the prior art adopt an upward and downward sliding displacement of the left foot and left hand in the same direction, and an upward and downward sliding displacement of the right foot and right hand in the same direction. If different training modes are required, such as changing to an upward and downward sliding displacement of the left foot and right hand in the same direction, and an upward and downward sliding displacement of the right foot and left hand in the same direction, the entire structure of the climber apparatus must be changed, which is considerably problematic and difficult with regard to design, mold making, manufacture, and assembly.

SUMMARY OF THE INVENTION

In order to resolve the above-described shortcomings in the climber apparatus of the prior art, the present invention provides a transmission structure for changing sliding direction of a climber apparatus, which enables an operator to operate the apparatus in an upright position. The transmission structure for changing sliding direction of a climber apparatus comprises: a base; a support, which is vertical positioned on the base, wherein the support is positioned between the two legs of the operator and comprises a first side and a second side; a first slide rail, which is mounted on the first side; a second slide rail, which is mounted on the second side; a first transmission unit, comprising a first drive member that is mounted so as to loop the first side, wherein the first drive member comprises a first near section and a first far section, and the linear directions of motion of the first near section and the first far section are opposite; a second transmission unit comprising a second drive member, which is mounted so as to loop the second side, wherein the second drive member comprises a second near section and a second far section, the linear directions of motion of the second near section and the second far section are opposite, and the second transmission unit and the first transmission unit are in synchronized motion; a first handle slider that is fixed to a first handle, wherein the first handle slider slides in the first slide rail; a first footplate slider, which is fixed to a first footplate, wherein the first footplate slider slides in the first slide rail; a second handle slider, which is fixed to a second handle, wherein the second handle slider slides in the second slide rail; a second footplate slider, which is fixed to a second footplate, wherein the second footplate slider slides in the second slide rail; and a resistance unit, which is mounted on the base or/and the support, wherein the resistance unit is connected to the first transmission unit or/and the second transmission unit, and provides a resistance force to the first transmission unit or/and the second transmission unit. The first footplate slider and the second footplate slider are respectively connected to any two of the first near section, the first far section, the second near section, and the second far section, at positions having opposite linear directions of motion . The first handle slider connects to the first drive member or the second drive member, and is positioned at a first selected position, wherein the directions of motion of the first selected position and the first footplate slider are opposite. Moreover, the second handle slider connects to the first drive member or the second drive member, and is positioned at a third selected position, wherein the directions of motion of the third selected position and the second footplate slider are opposite. Or, the first handle slider connects to the first drive member or the second drive member, and is positioned at a second selected position, wherein the directions of motion of the second selected position and the first footplate slider are the same. Moreover, the second handle slider connects to the second drive member or the first drive member at a fourth selected position, wherein the directions of motion of the fourth selected position and the second footplate slider are the same.

The above-described first transmission unit further comprises a first upper driving wheel and a first lower driving wheel, wherein the first upper driving wheel is mounted on one end of the support, and the first lower driving wheel is mounted on the other end of the support. The first drive member is configured between the first upper driving wheel and the first lower driving wheel. The second transmission unit further comprises a second upper driving wheel and a second lower driving wheel, wherein the second upper driving wheel is mounted on one end of the support corresponding to the first upper driving wheel, and the second lower driving wheel is mounted on the other end of the support corresponding to the first lower driving wheel. The second drive member is configured between the second upper driving wheel and the second lower driving wheel.

The above-described first upper driving wheel and the second upper driving wheel are coaxially mounted on one end of the support, and the first lower driving wheel and the second lower driving wheel are coaxially mounted on the other end of the support.

The above-described first upper driving wheel and the second upper driving wheel are joined to upper spindles, and the upper spindles are joined to the support. The first upper driving wheel and the second upper drive can be respectively mounted so as to rotate back and forth on the upper spindles. The first lower driving wheel and the second lower driving wheel are commonly joined to the lower spindle, and the lower spindle is mounted so as to rotate back and forth on the support, thereby enabling the first lower driving wheel and the second lower driving wheel to rotate back and forth in synchrony.

A connecting line between the upper spindle axis of the upper spindles and the lower spindle axis of the lower spindle divides the first drive member into a first near section and a first far section. In addition, the connecting line divides the second drive member into a second near section and a second far section.

The above-described resistance unit comprises a driving wheel, a driven wheel, a resistance wheel, a magnetic resistance member, a first belt, and a second belt, wherein the driving wheel is fixed to the lower spindle, and rotates back and forth in synchrony with the lower spindle. The driven wheel and the resistance wheel are correspondingly fixed to the base. The first belt is mounted between the driving wheel and the driven wheel, and the second belt is mounted between the driven wheel and the resistance wheel. The magnetic resistance member is mounted so as to rotate on the support, to enable exerting a resistance force on the resistance wheel, as well as enabling the resistance wheel to transmit a resistance force through the second belt, the driven wheel, the first belt, and the driving wheel. The resistance force is also transmitted to the first handle, the first footplate, the second handle, and the second footplate through the first drive member and the second drive member.

The above-described first slide rail comprises a first near slide rail and a first far slide rail, wherein the first near slide rail is configured to the support close to the position of the operator, and the first footplate slider slides in the first slide rail. The first far slide rail is configured to the support at a distance from the position of the operator, and the first handle slider slides in the first slide rail. The second slide rail comprises a second near slide rail and a second far slide rail, wherein the second near slide rail is configured to the support close to the position of the operator, and the second footplate slider slides in the second slide rail. The second far slide rail is configured to the support at a distance from the position of the operator, and the second handle slider slides in the second slide rail.

The above-described first footplate slider is configured with a first footplate connecting piece that connects to the first drive member or the second drive member, and the first handle slider is configured with a first handle connecting piece that connects to the first drive member or the second drive member. The second footplate slider is configured with a second footplate connecting piece that connects to the first drive member or the second drive member, and the second handle slider is configured with a second handle connecting piece that connects to the first drive member or the second drive member.

The above-described support is configured with an auxiliary frame at a distance from one end of the base, wherein the auxiliary frame is configured with an auxiliary handle adjacent to the position of the operator. The auxiliary frame is configured with a display unit at a distance from the position of the operator. The first handle is provided with a first handle upper section, and the second handle is provided with a second handle upper section. The distance between the first handle upper section and the second handle upper section is greater than the width of the display unit.

The above-described technical characteristics have the following advantages:

1. The components including the support, the first slide rail, the first handle slider, the first footplate slider, the first transmission unit, the second slide rail, the second handle slider, the second footplate slider, and the second transmission unit are all configured on the center line position of the operator's torso when in an upright position, thereby substantially decreasing the size of the entire climber apparatus.
2. Under the prerequisite that the left foot and right foot of the operator carry out alternate reverse treading throughout the exercise routine, the climber apparatus of the present invention provides the following training modes: the left foot and left hand of the operator are throughout distancing from each other or nearing each other; the right hand and the right foot are throughout distancing from each other or nearing each other; the right hand and left foot of the operator are in synchronized motion in the same direction, and the left hand and right foot are also in synchronized motion in the same direction; or the right hand and right foot of the operator are in synchronized motion in the same direction, and the left hand and left foot are also in synchronized motion in the same direction, which is used to train synchronized and coordinated force application of the hands and feet to simulate actual rock climbing and mountaineering.
3. During production and manufacture, the first handle slider, the first footplate slider, the second handle slider, and the second footplate slider can be respectively connected to the first drive member or the second drive member at different selected positions. Under the prerequisite that the left foot and right foot of the operator carry out alternate reverse treading throughout the exercise routine, different training modes can be selected, including synchronized motion of the left foot and the right foot in the same direction and the right foot and left hand in the same direction, or synchronized motion of the left foot and left hand in the same direction and the right foot and right hand in the same direction, thereby completely eliminating the need to change any transmission mechanism, thus facilitating quick assembly and production.

To enable a further understanding of said objectives, structures, characteristics, and effects, as well as the technology and methods used in the present invention and effects achieved, a brief description of the drawings is provided below followed by a detailed description of the preferred embodiments.

DETAILED DESCRIPTION OF THE PREFERRED EMBODIMENTS

In each of the embodiments of the present embodiment, the left foot and the right foot alternately tread in mutually opposite directions throughout the exercise routine.

Figure 1:
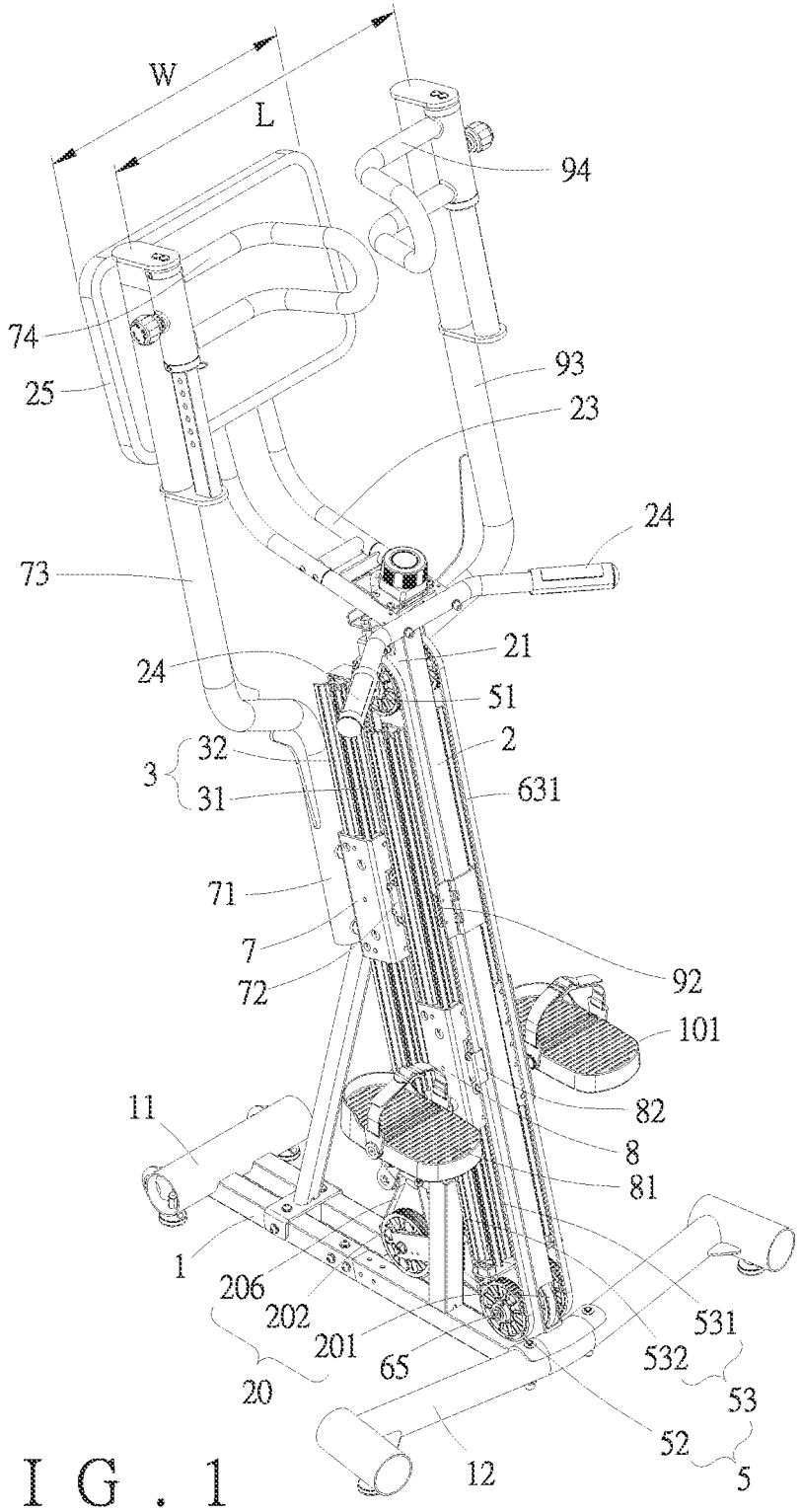
FIG. 1 is a three-dimensional external view of a first embodiment of the present invention.
Figure 2:
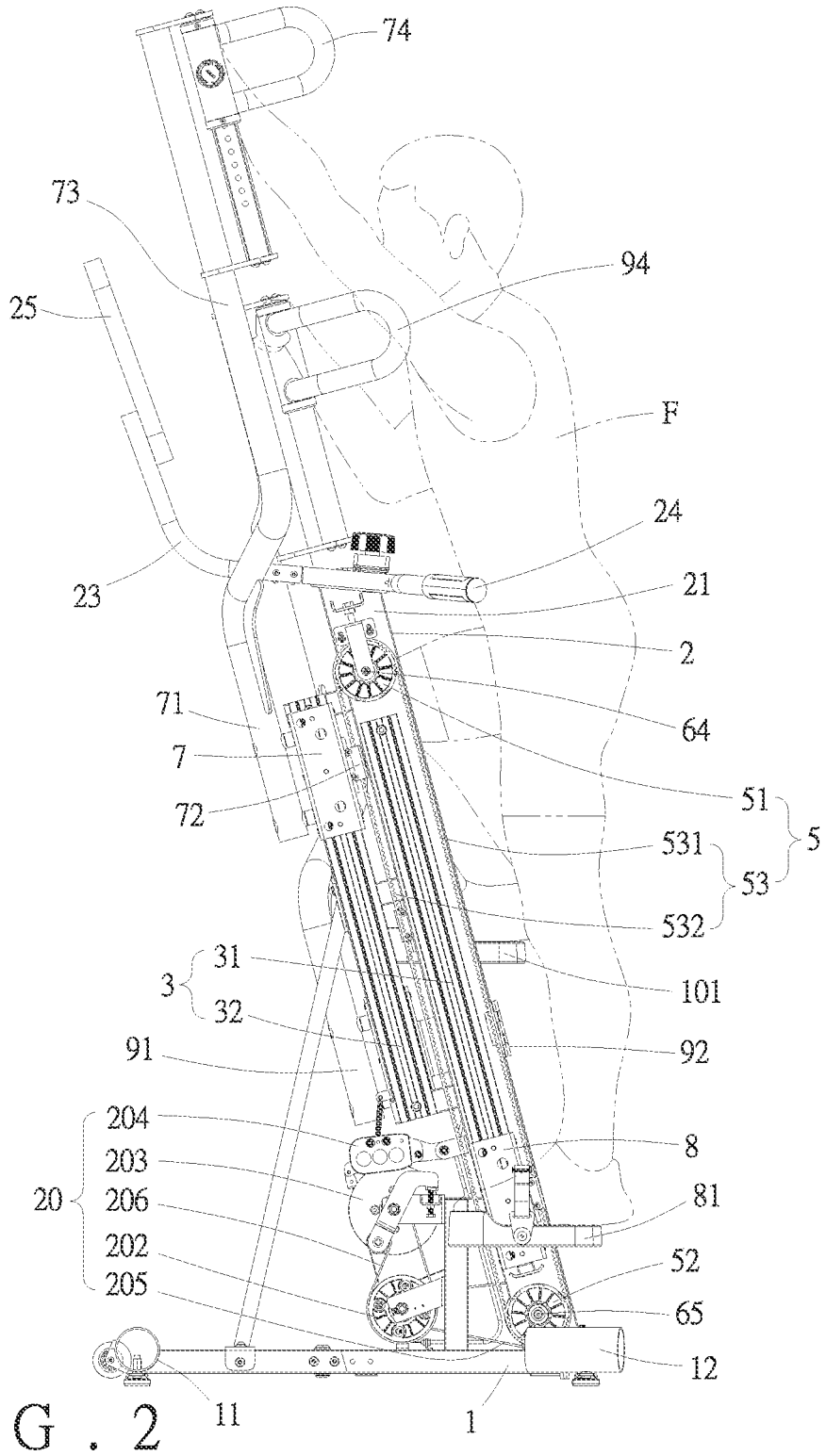
FIG. 2 is a side view of the first embodiment in use according to the present invention.
Figure 3:
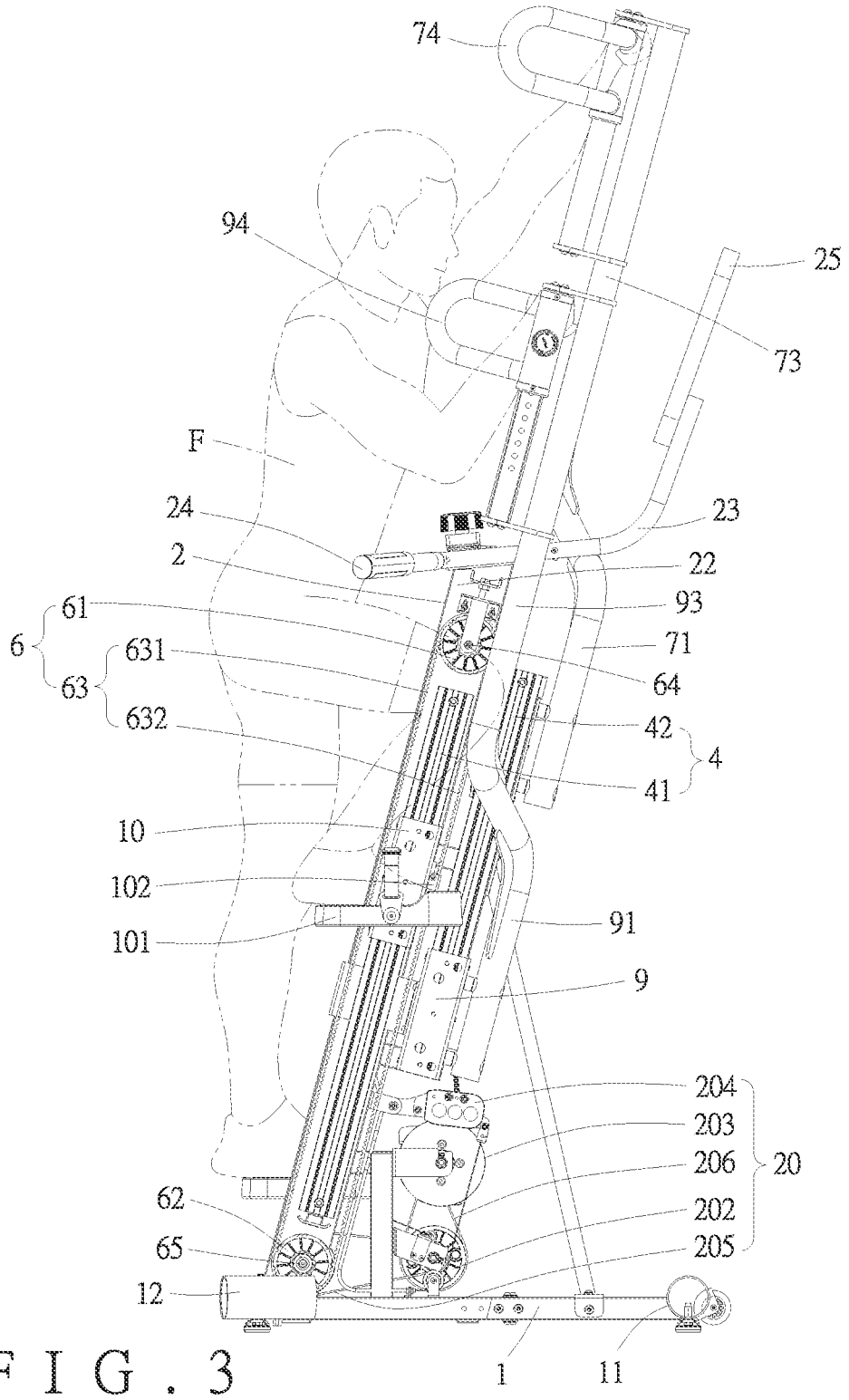
FIG. 3 is another side view of the first embodiment in use according to the present invention.

Referring to FIG. 1, FIG. 2, and FIG. 3, which show a first embodiment of a transmission structure for changing sliding direction of a climber apparatus of the present invention, which enables an operator F to operate the apparatus in an upright position. The transmission structure for changing sliding direction of the climber apparatus comprises: a base 1, a support 2, a first slide rail 3, a second slide rail 4, a first transmission unit 5, a second transmission unit 6, a first handle slider 7, a first footplate slider 8, a second handle slider 9, a second footplate slider 10, and a resistance unit 20; wherein:

The base 1 is provided with a first support bar 11 and a second support bar 12 correspondingly configured to the front and rear thereof, which enable stable underpinning against a flat surface, such as the ground. However, the base 1 can be other shapes, and the present invention is not limited by such.

The support 2 is vertically mounted on the base 1 and positioned between the two legs of the operator F. The support 2 comprises a first side 21 and a second side 22, as shown in FIGS. 2 and 3. The first side 21 is positioned on the left side of the operator F during operation, and the second side 22 is positioned on the right side of the operator F during operation. The support 2 is configured with an auxiliary frame 23 at a distance from one end of the base 1, and the auxiliary frame 23 is configured with an auxiliary handle 24 close to the position of the operator F. The auxiliary frame 23 is configured with a display unit 25 at a distance from the position of the operator F, wherein the display unit 25 enables displaying: exercise information, infotainment (entertainment information), instructional information, and internet information.

The first slide rail 3 is mounted on the first side 21 and comprises a first near slide rail 31 and a first far slide rail 32. The first near slide rail 31 is configured to the support 2 close to the position of the operator F, and the first far slide rail 32 is configured to the support 2 at a distance from the position of the operator F.

The second slide rail 4 is mounted on the second side 22 and comprises a second near slide rail 41 and a second far slide rail 42. The second near slide rail 41 is configured to the support 2 close to the position of the operator F, and the second far slide rail 42 is configured to the support 2 at a distance from the position of the operator F.

Figure 4:
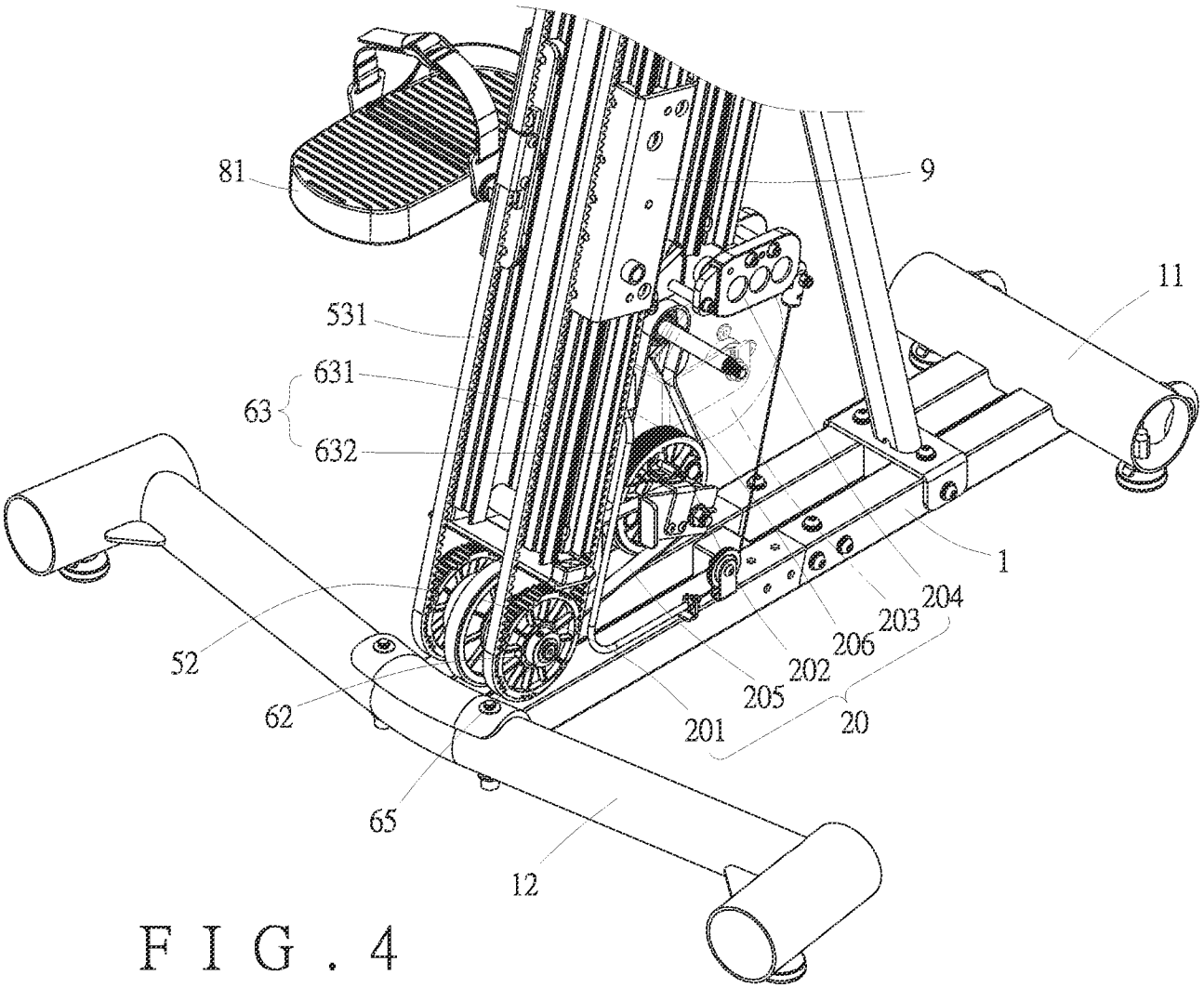
FIG. 4 is a structural schematic view of a resistance unit of the first embodiment of the present invention.
Figure 5:
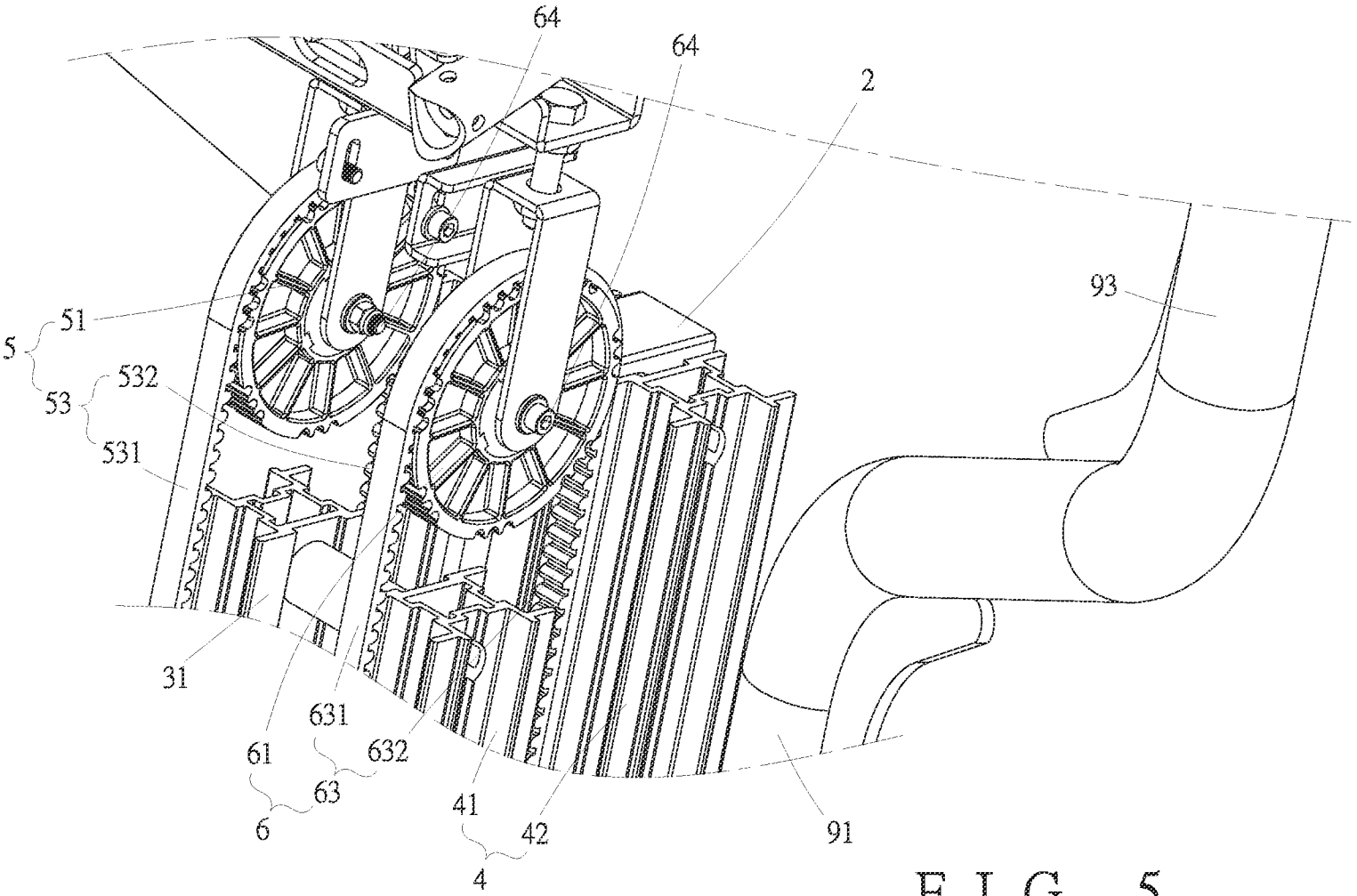
FIG. 5 is a schematic view of a first upper driving wheel and a second upper driving wheel meshing with a first drive member and a second drive member, respectively, according to the first embodiment of the present invention. (the present drawing omits a support of the first embodiment)
Figure 5A:
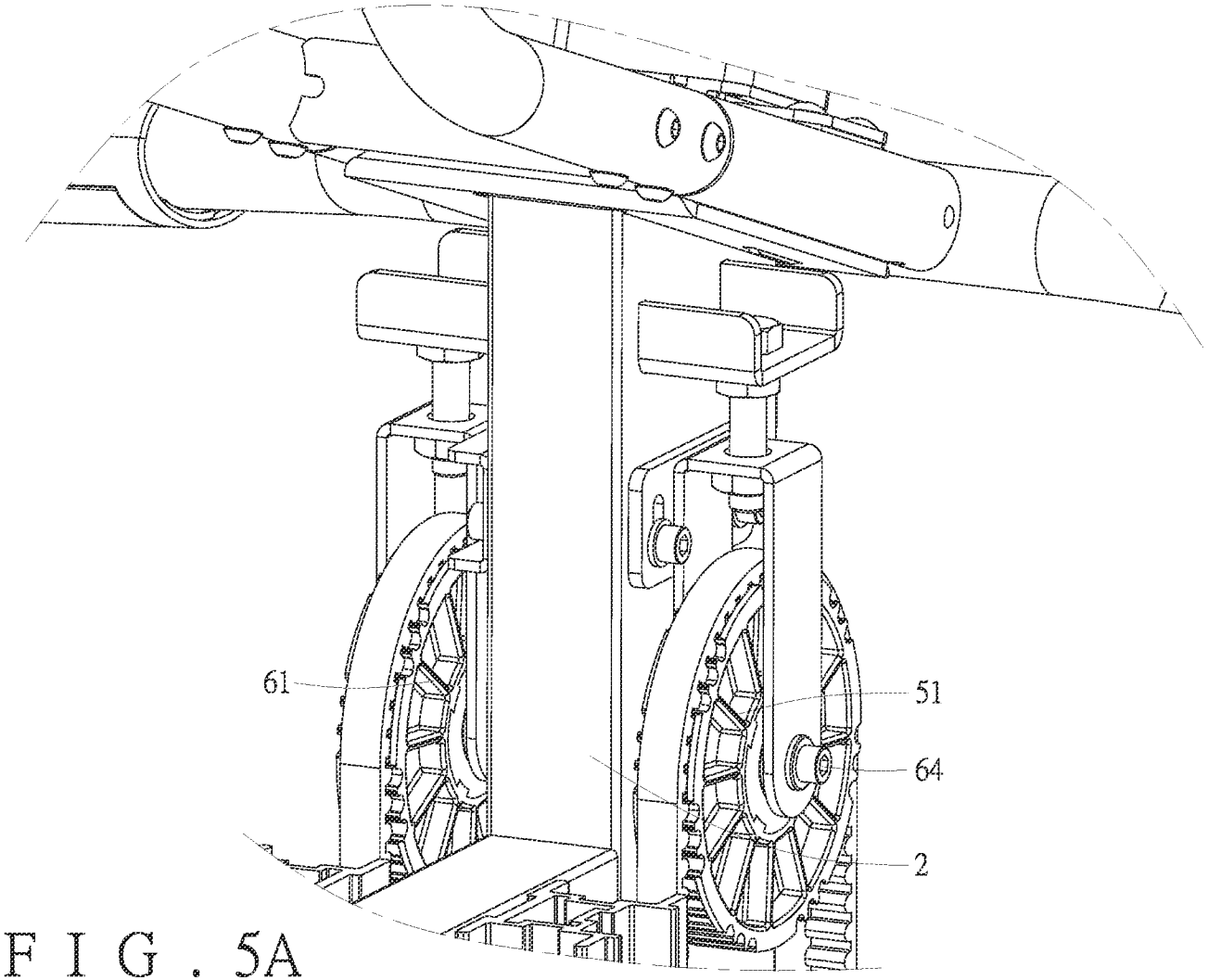
FIG. 5A is a schematic view of the first upper driving wheel mounted on one end of the support according to the first embodiment of the present invention.
Figure 6:
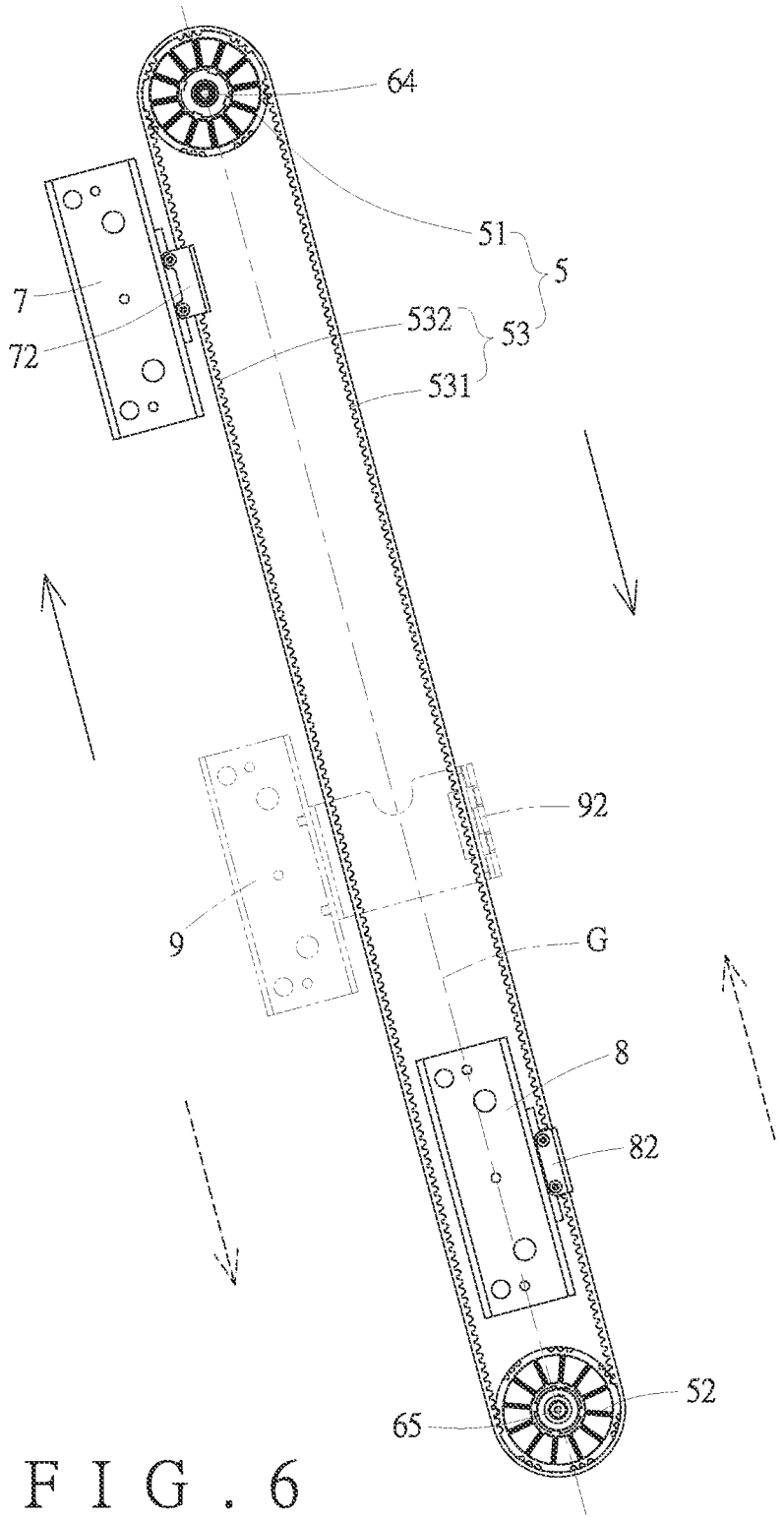
FIG. 6 is a schematic view showing a connecting line dividing the first drive member into a first near section and a first far section according to the first embodiment of the present invention.

The first transmission unit 5 is mounted on the first side 21 and comprises a first upper driving wheel 51, a first lower driving wheel 52, and a first drive member 53 (as shown in FIGS. 4 and 5). The first upper driving wheel 51 is mounted on one end of the support 2 (as shown in FIG. 5A), and the first lower driving wheel 52 is mounted on the other end of the support 2. The first drive member 53 is mounted so as to loop on the first side 21, that is, the first drive member 53 is mounted between the first upper driving wheel 51 and the first lower driving wheel 52 (as shown in FIG. 6). The first lower driving wheel 52 synchronously drives the first upper driving wheel 51 in a limited back and forth rotation through the first drive member 53.

Figure 7:
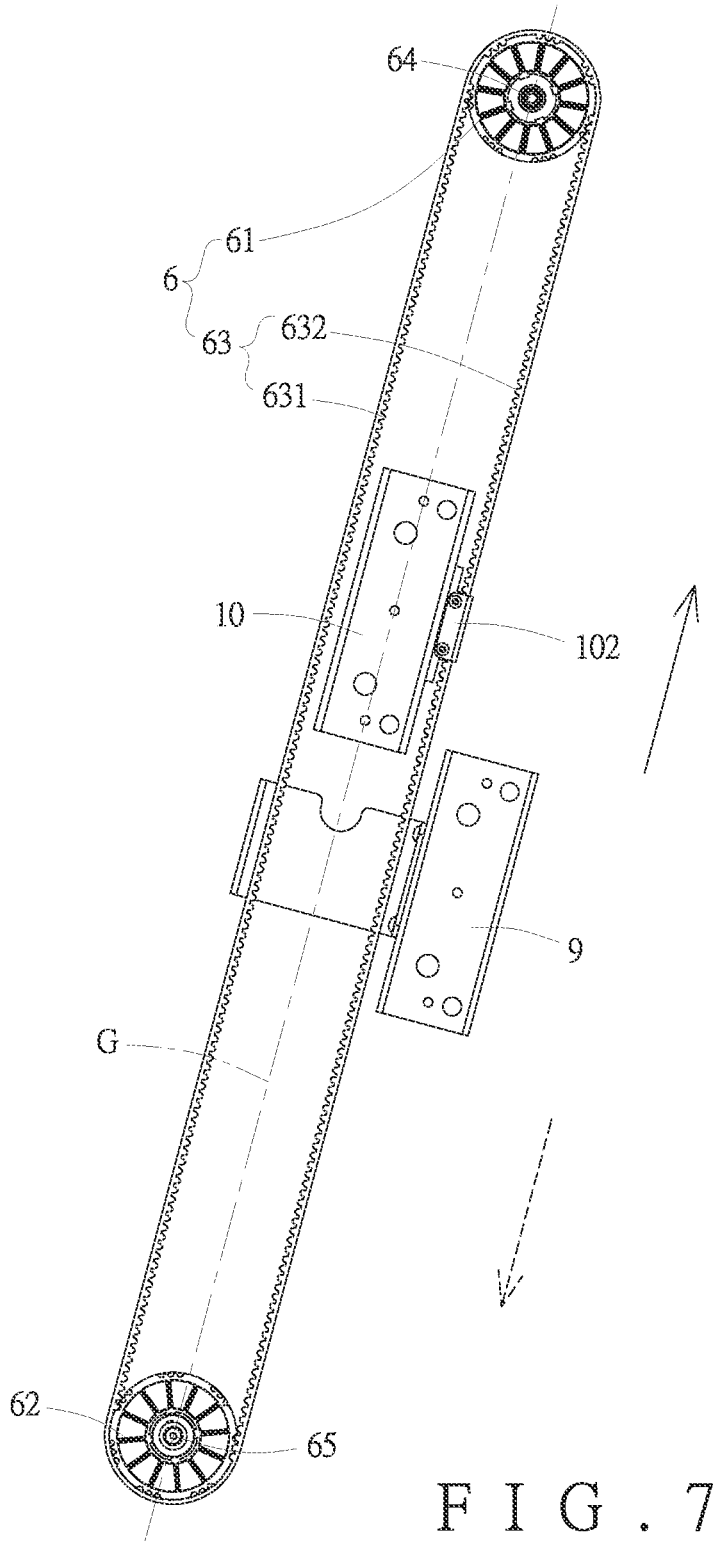
FIG. 7 is a schematic view showing a connecting line separating the second drive member into a second near section and a second far section according to the first embodiment of the present invention.
Figure 12:
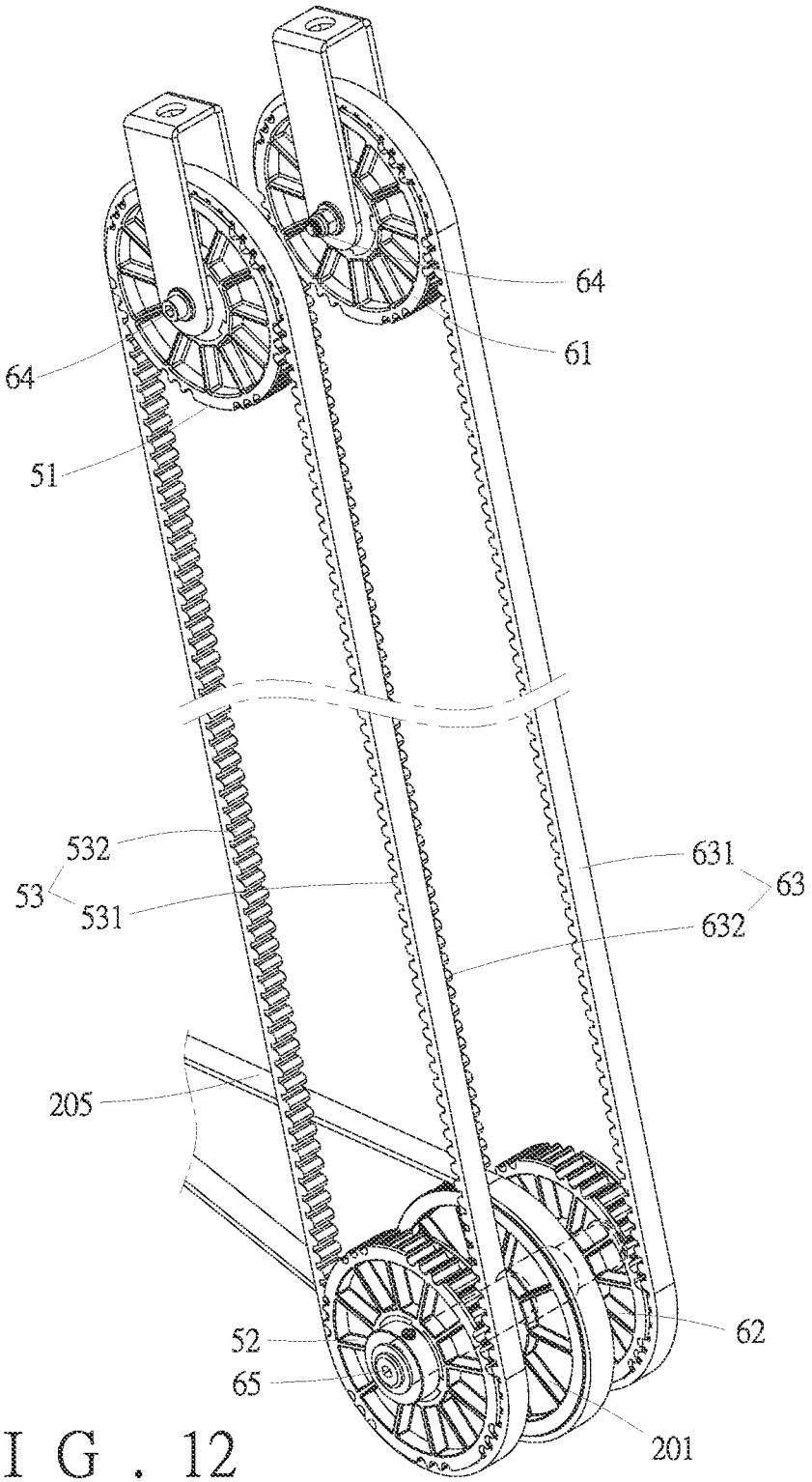
FIG. 12 is a schematic view of the first upper driving wheel and a second upper driving wheel respectively fixed to two upper spindles; and a first lower driving wheel and a second lower driving wheel are commonly joined to a lower spindle according to the first embodiment of the present invention.

The second transmission unit 6 is mounted on the second side 22 and comprises a second upper driving wheel 61, a second lower driving wheel 62, and a second drive member 63 (as shown in FIGS. 4 and 5). The second upper driving wheel 61 is mounted on one end of the support 2 corresponding to the first upper driving wheel 51 (as shown in FIG. 5A), and the second lower driving wheel 62 is mounted on the other end of the support 2 corresponding to the first lower driving wheel 52. The second drive member 63 is mounted so as to loop the second side 22, that is, the second drive member 63 is mounted between the second upper driving wheel 61 and the second lower driving wheel 62 (as shown in FIG. 7). Referring to FIGS. 1 and FIG. 12, wherein FIG. 12 omits the support 2, the first upper driving wheel 51 and the second upper driving wheel 61 are respectively joined to upper spindles 64, which are joined to the support 2, and the first upper driving wheel 51 and the second upper driving wheel 61 are respectively mounted so as to rotate back and forth on the upper spindles 64. Apart from the present first embodiment, the above-described two upper spindles 64 can be replaced with a single upper spindle, whereby the above-described first upper driving wheel 51 and the second upper driving wheel 61 can then be mounted so as to rotate back and forth on a single upper spindle. The first lower driving wheel 52 and the second lower driving wheel 62 are commonly joined to a lower spindle 65, and the lower spindle 65 is mounted so as to rotate back and forth on the support 2, thereby enabling the first lower driving wheel 52 and the second lower driving wheel 62 to rotate back and forth in synchrony with the lower spindle 65. The first lower driving wheel 52 synchronously drives the first upper driving wheel 51 to rotate back and forth through the first drive member 53, and the second lower driving wheel 62 synchronously drives the second upper driving wheel 61 to rotate back and forth through the second drive member 63. Referring to FIG. 6 and FIG. 7, a connecting line G between the upper spindle axis of the upper spindles 64 and the lower spindle axis of the lower spindle 65 divides the first drive member 53 into a first near section 531 close to the operator F and a first far section 532 at a distance from the operator F. Moreover, the linear directions of motion of the first near section 531 and the first far section 532 are mutually opposite. Furthermore, the connecting line G divides the second drive member 63 into a second near section 631 close to the operator F and a second far section 632 at a distance from the operator F. Moreover, the linear directions of motion of the second near section 631 and the second far section 632 are mutually opposite.

Referring to FIGS. 1, 2, 6, and 8, which show a first handle 71 fixed to a first handle slider 7, which is configured with a first handle connecting piece 72. The first handle connecting piece 72 is connected to the first far section 532 of the first drive member 53 (as shown in FIG. 6). The first far section 532 drives the first handle slider 7 to slide on the first far slide rail 32 of the first slide rail 3, and the first handle slider 7 drives and synchronously displaces the first handle 71. In addition, the first handle 71 extends upward and is provided with a first handle upper section 73, which is configured with a first grip 74.

Figure 8:
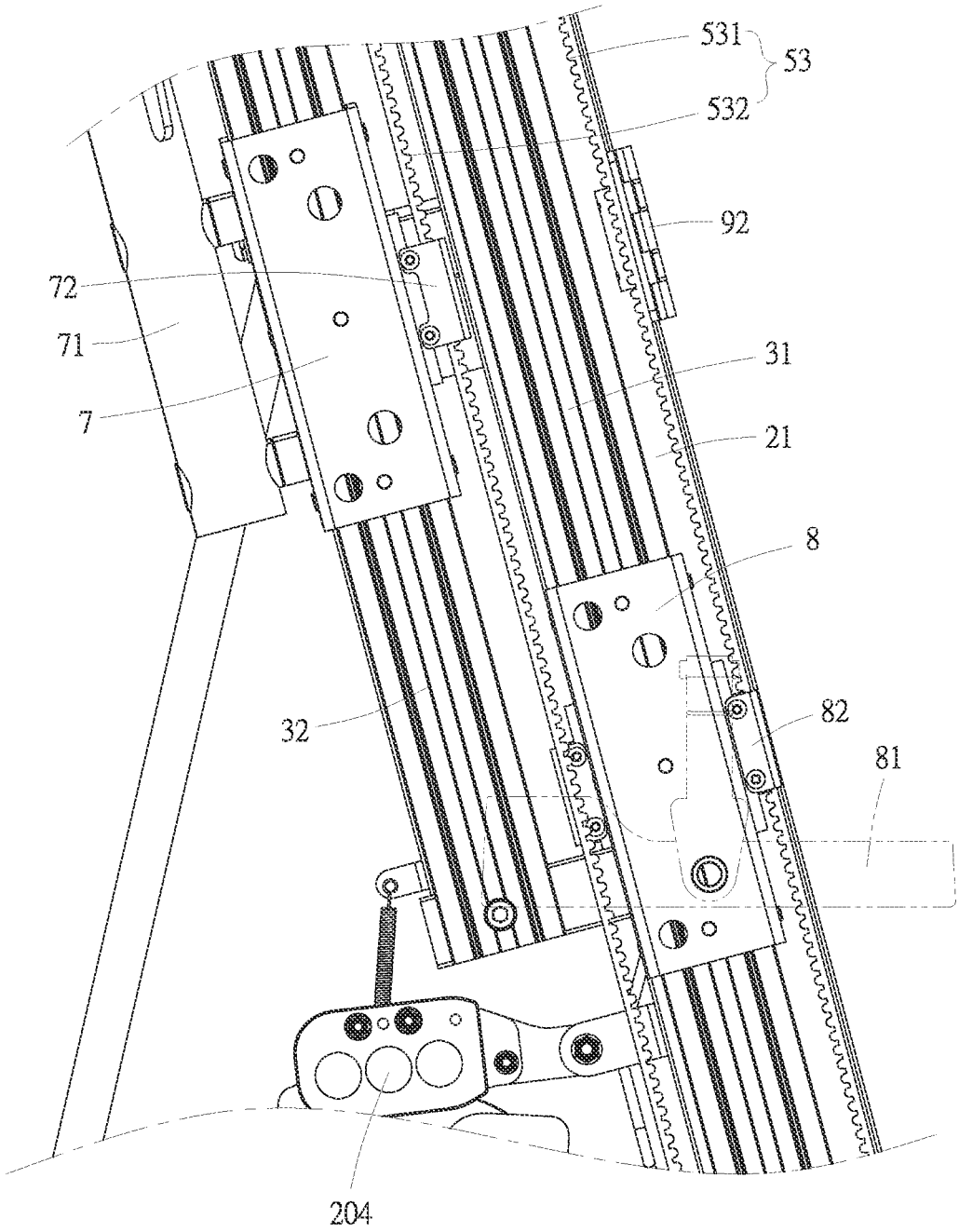
FIG. 8 is a schematic view of a first handle slider and a first footplate slider sliding in a first slide rail according to the first embodiment of the present invention.

A first footplate 81 is fixed to the first footplate slider 8, which is configured with a first footplate connecting piece 82. The first footplate connecting piece 82 is connected to the first near section 531 of the first drive member 53 (as shown in FIG. 8). The first near section 531 drives the first footplate slider 8 to slide on the first near slide rail 31 of the first slide rail 3, and the first footplate slider 8 drives and synchronously displaces the first footplate 81.

Figure 9:
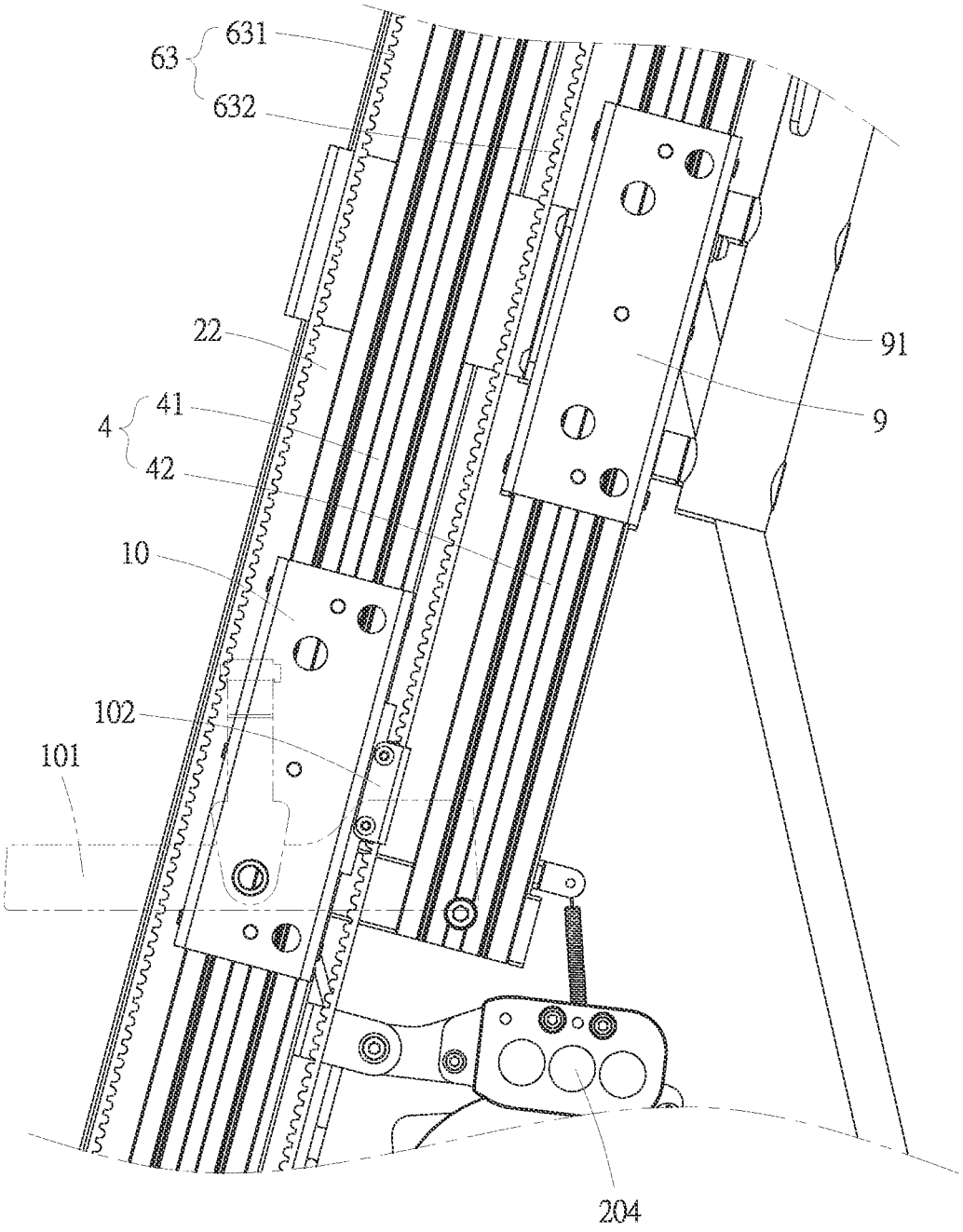
FIG. 9 is a schematic view of a second handle slider and a second footplate slider sliding in a second slide rail according to the first embodiment of the present invention.
Figure 10:
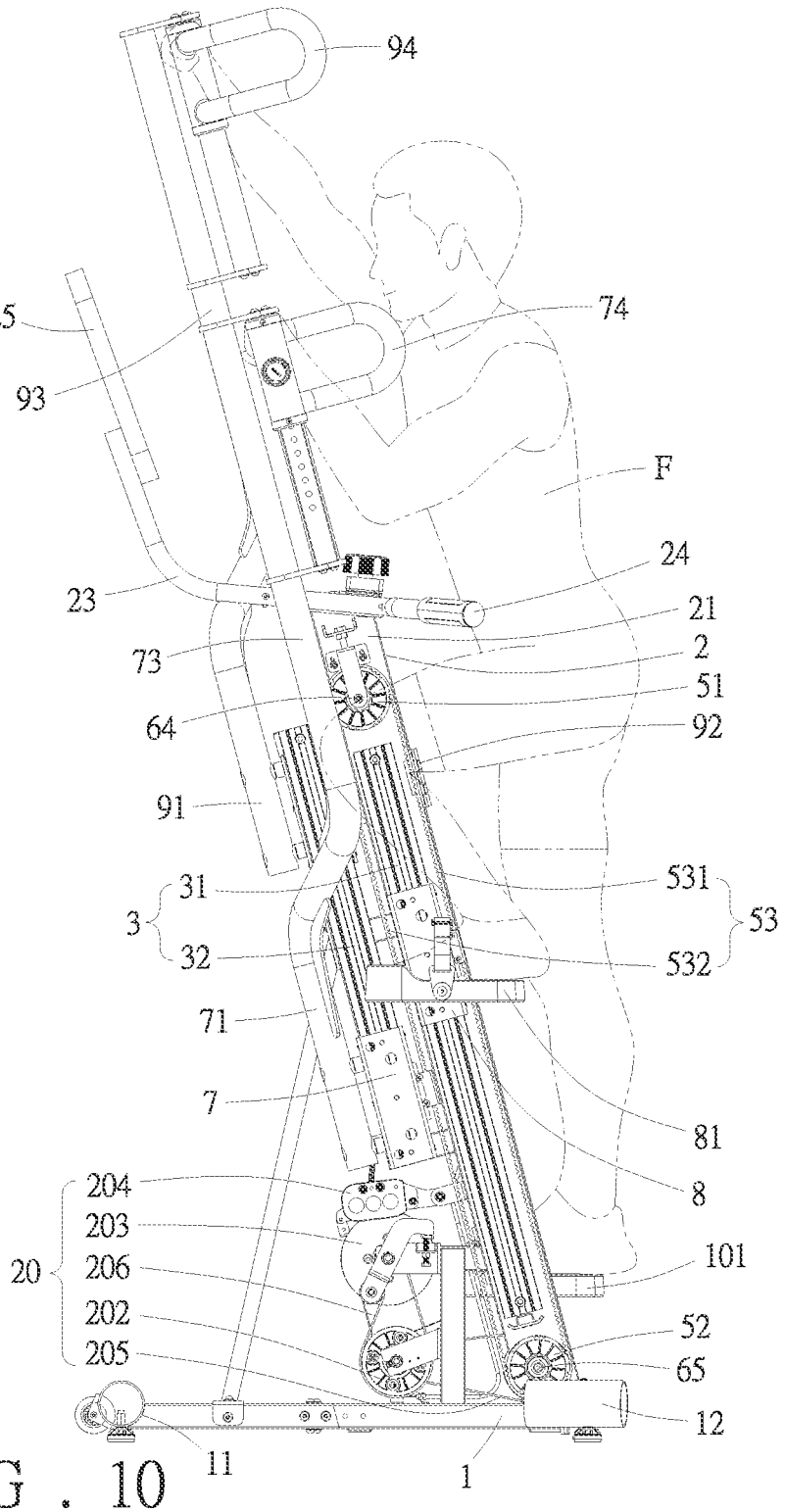
FIG. 10 is a schematic view showing upward and downward sliding of a first handle and a first footplate in the first slide rail according to the first embodiment of the present invention.
Figure 11:
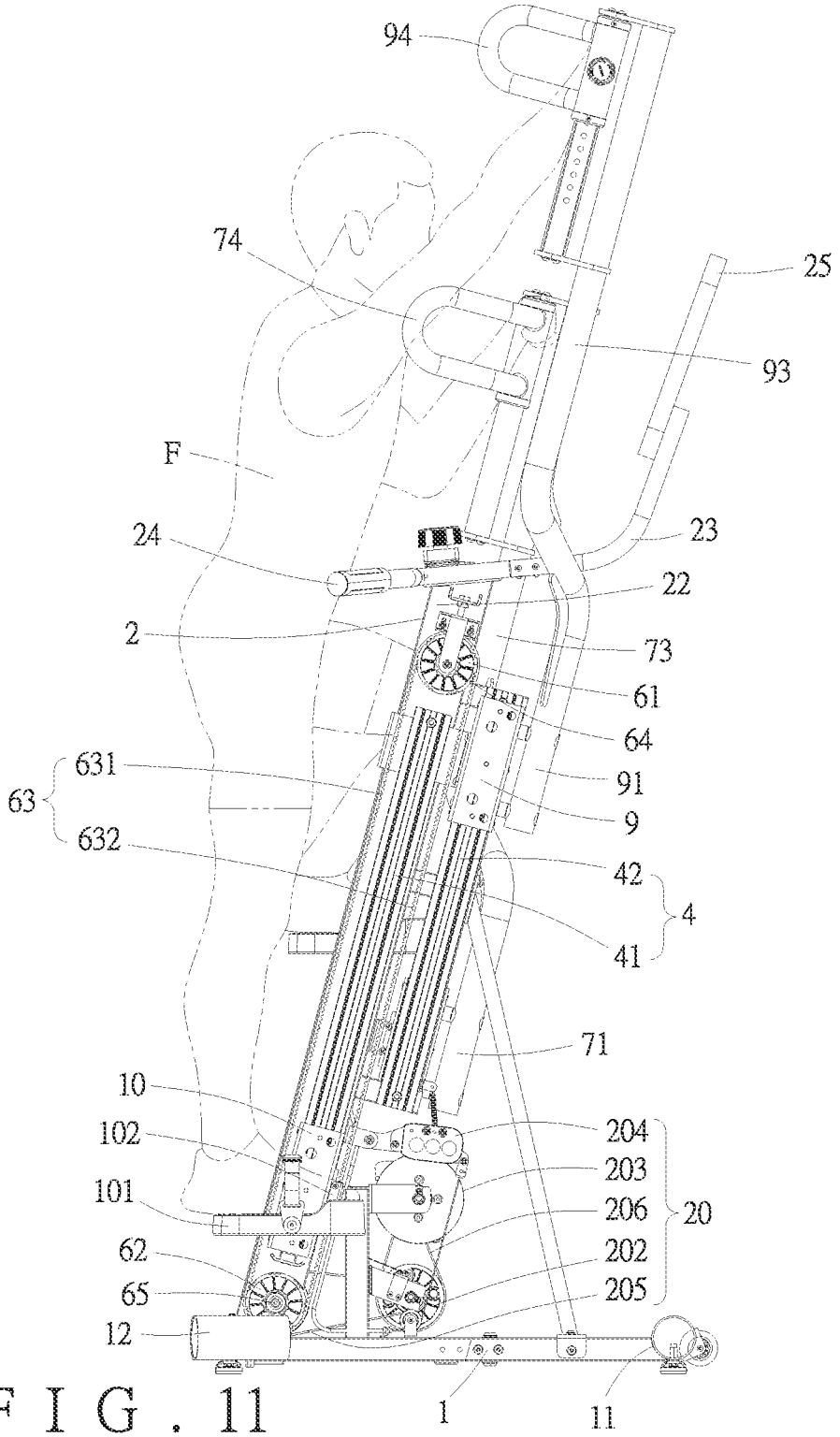
FIG. 11 is a schematic view showing upward and downward sliding of a second handle and a second footplate in the second slide rail according to the first embodiment of the present invention.

Referring to FIGS. 1, 3, 7, 8, and 9, wherein a second handle 91 is fixed to the second handle slider 9, which is configured with a second handle connecting piece 92 that winds round to the first side 21 from the second side 22 of the support 2 (as shown in FIGS. 8 and 9) and connects to the first near section 531 of the first drive member 53. The first near section 531 drives the second handle slider 9 to slide on the second far slide rail 42 of the second slide rail 4, and the second handle slider 9 drives and synchronously displaces the second handle 91. The second handle 91 extends upward and is provided with a second handle upper section 93, which is provided with a second grip 94, as shown in FIG. 1. A distance L between the first handle upper section 73 and the second handle upper section 93 is greater than a width W of the display unit 25, thereby avoiding blocking the line of vision of the operator when viewing the display unit 25.

A second footplate 101 is fixed to the second footplate slider 10, which is configured with a second footplate connecting piece 102 that is connected to the second far section 632 of the second drive member 63 (as shown in FIG. 9). The second far section 632 drives the second footplate slider 10 to slide on the second near slide rail 41 of the second slide rail 4, and the second footplate slider 10 also drives and synchronously displaces the second footplate 101.

Referring to FIG. 6 and FIG. 7, wherein the first embodiment of the present invention mainly connects the first footplate slider 8 and the second footplate slider 10, respectively, to any two of the first near section 531, the first far section 532, the second near section 631, and the second far section 632, at positions having opposite linear directions of motion (the first footplate slider 8 connects to the first near section 531, and the second footplate slider 10 connects to the second far section 632). The first handle slider 7 then connects to the first drive member 53, and is positioned at a first selected position (connects to the first far section 532) or the second drive member 63, wherein the direction of motion of the first selected position is opposite to the direction of motion of the first footplate slider 8. Moreover, the second handle slider 9 connects to the first drive member 53, and is positioned at a third selected position (connects to the first near section 531) or the second drive member 63, wherein the direction of motion of the third selected position is opposite to the direction of motion of the second footplate slider 10.

Referring FIG. 4 and FIG. 12, wherein the resistance unit 20 is mounted to the base 1 or/and the support 2, and is also connected to the first transmission unit 5 or/and the second transmission unit 6. In the first embodiment of the present invention, the resistance unit 20 is mounted between the base 1 and the support 2, and is simultaneously connected to the first transmission unit 5 and the second transmission unit 6, whereby the resistance unit 20 exerts a resistance force on the first transmission unit 5 and the second transmission unit 6. The resistance unit 20 comprises a driving wheel 201, a driven wheel 202, a resistance wheel 203, a magnetic resistance member 204, a first belt 205, and a second belt 206, wherein the driving wheel 201 is joined to the lower spindle 65, and, within limits, rotates back and forth in synchrony therewith. The driven wheel 202 and the resistance wheel 203 are correspondingly joined to the base 1. The first belt 205 is mounted between the driving wheel 201 and the driven wheel 202, and the second belt 206 is mounted between the driven wheel 202 and the resistance wheel 203. The magnetic resistance member 204 is pivot connected to the support 2, thereby enabling limited angular rotation of the magnetic resistance member 204 relative to the resistance wheel 203, which is used to change the affect the magnetic force has on the resistance wheel 203, and enabling the resistance wheel 203 to attain variable resistance force. The resistance wheel 203 transmits a resistance force through the second belt 206, the driven wheel 202, the first belt 205, and the driving wheel 201, whereupon the resistance force is transmitted to the first handle 71 of the first handle slider 7, the first footplate 81 of the first footplate slider 8, the second handle 91 of the second handle slider 9, and the second footplate 101 of the second footplate slider 10 through the first drive member 53 and the second drive member 63.

Referring to FIGS. 2, 3, and 12, when in use, the left foot of the operator F treads and applies force on the first footplate 81, and the right foot of the operator F treads and applies force on the second footplate 101. The left hand of the operator F grips the first grip 74 or grips the auxiliary handle 24, and the right hand of the operator F grips the second grip 94 or grips the auxiliary handle 24. During operation, the left foot and right foot of the operator F carry out continuous alternate treading on the first footplate 81 and the second footplate 101 respectively. And because the driving wheel 201, the first lower driving wheel 52, and the second lower driving wheel 62 are commonly joined to the lower spindle 65, thus, they all mutually synchronously rotate, and this synchronous rotation has limited, continuous, reverse directional back and forth rotation, and does not continuously rotate in the same direction. When the left foot and right foot of the operator F are carrying out continuous alternate treading, the back and forth travel distance of the first footplate 81 drives the first drive member 53 through a limited back and forth rotation, and the back and forth travel distance of the second footplate 101 drives the second drive member 63 through a limited back and forth rotation.

Referring to FIGS. 1, 2, 6, and 10, because the first footplate slider 8 is connected to the first near section 531 of the first drive member 53, and the second handle slider 9 is also connected to the first near section 531 of the first drive member 53, when the left foot of the operator F treads downward, the first near section 531 drives the first footplate slider 8 and the second handle slider 9 to synchronously displace downwards (as shown by the solid arrow direction in FIG. 6). When the left foot and right hand of the operator F are synchronously displaced downward, the first far section 532 drives and upwardly displaces the first handle slider 7 (as shown by the solid arrow direction in FIG. 6). Accordingly, the left foot and left hand of the operator F are distancing from each other in opposite directions. Referring to FIGS. 1, 2, and 7, because the first drive member 53 and the second drive member 63 synchronously rotate in the same direction, when the left foot of the operator F treads downward, the second far section 632 drives and upwardly displaces the second footplate slider 10 (as shown by the solid arrow direction in FIG. 7). Accordingly, the right foot of the operator F is upwardly displaced, at which time, the right foot and the right hand of the operator F are nearing each other from opposite directions.

Referring to FIGS. 1, 3, 7, and 11, when the right foot of the operator F treads downward, the second far section 632 drives and downwardly displaces the second footplate slider 10 (as shown by the dotted arrow direction in FIG. 7), at which time, referring to FIGS. 1, 2, and 6, the first near section 531 drives and synchronously upwardly displaces the first footplate slider 8 and the second handle slider 9 (as shown by the dotted arrow direction in FIG. 6), and the first far section 532 then drives and downwardly displaces the first handle slider 7 (as shown by the dotted arrow direction in FIG. 6). Accordingly, when the right foot of the operator F treads downward, the left foot of the operator F is upwardly displaced, and the right foot and right hand of the operator F are distancing from each other in opposite directions, and the left foot and left hand of the operator F are nearing each other from opposite directions.

Referring to FIGS. 2, 3, 6, 7, and 12, the first handle slider 7 and the first footplate slider 8 are fixed to the first transmission unit 5, which is used so as to be mutually positioned together on the first side 21 of the support 2. The second handle slider 9 is fixed to the first transmission unit 5, and the second footplate slider 10 is fixed to the second transmission unit 6, which is used so as to be mutually positioned together on the second side 22 of the support 2. The left foot of the operator F applies force to the first transmission unit 5 and the right foot of the operator F applies force to the second transmission unit 6, thereby balancing the applied forces on the first side 21 and the second side 22, as well as providing a stable operational effect. Furthermore, the first footplate slider 8 is fixed to the first near section 531 of the first drive member 53, and the first handle slider 7 is fixed to the first far section 532, which enables achieving a displacement effect that enables the left foot and left hand of the operator F to be at a distance from each other or be close to each other when operating the apparatus. The second footplate slider 10 is fixed to the second far section 632 of the second drive member 63, and the second handle slider 9 is fixed to the first near section 531 of the first drive member 53, which also enables achieving a displacement effect that enables the right foot and right hand of the operator F to be distancing from each other or be nearing each other when operating the apparatus. The first lower driving wheel 52 and the second lower driving wheel 62 are commonly fixed to the lower spindle 65, thereby enabling the three together to synchronously rotate back and forth. When the left foot of the operator F treads downward, the first footplate slider 8 drives and downwardly displaces the first section 531 (as shown by the solid arrow direction in FIGS. 6 and 7), causing the second near section 631 to also synchronously downwardly displace, at which time, the first far section 532 upwardly displaces, causing the second far section 632 to also synchronously upwardly displace. When the right foot of the operator F treads downward, the second footplate slider 10 drives and downwardly displaces the second section 632 (as shown by the dotted arrow direction in FIGS. 6 and 7), causing the first far section 532 to also synchronously downwardly displace, at which time, the second near section 631 upwardly displaces, causing the first near section 531 to also synchronously upwardly displace. The synchronous transmission of the first lower driving wheel 52 and the second lower driving wheel 62 enables synchronous upward and downward slide displacement of the left foot and right hand of the operator F, as well as synchronous upward and downward slide displacement of the right foot and left hand of the operator F, to correspond to limb movements when rock climbing or mountaineering. The components of the present invention, including the support 2, the first slide rail 3, the second slide rail 4, the first transmission unit 5, and the second transmission unit 6 are all positioned on the two side positions of the center line of the upright torso of the operator F, accordingly, being positioned between the two legs of the operator F can substantially decrease the size of the climber apparatus as well as save on space occupied thereby.

Figure 13:
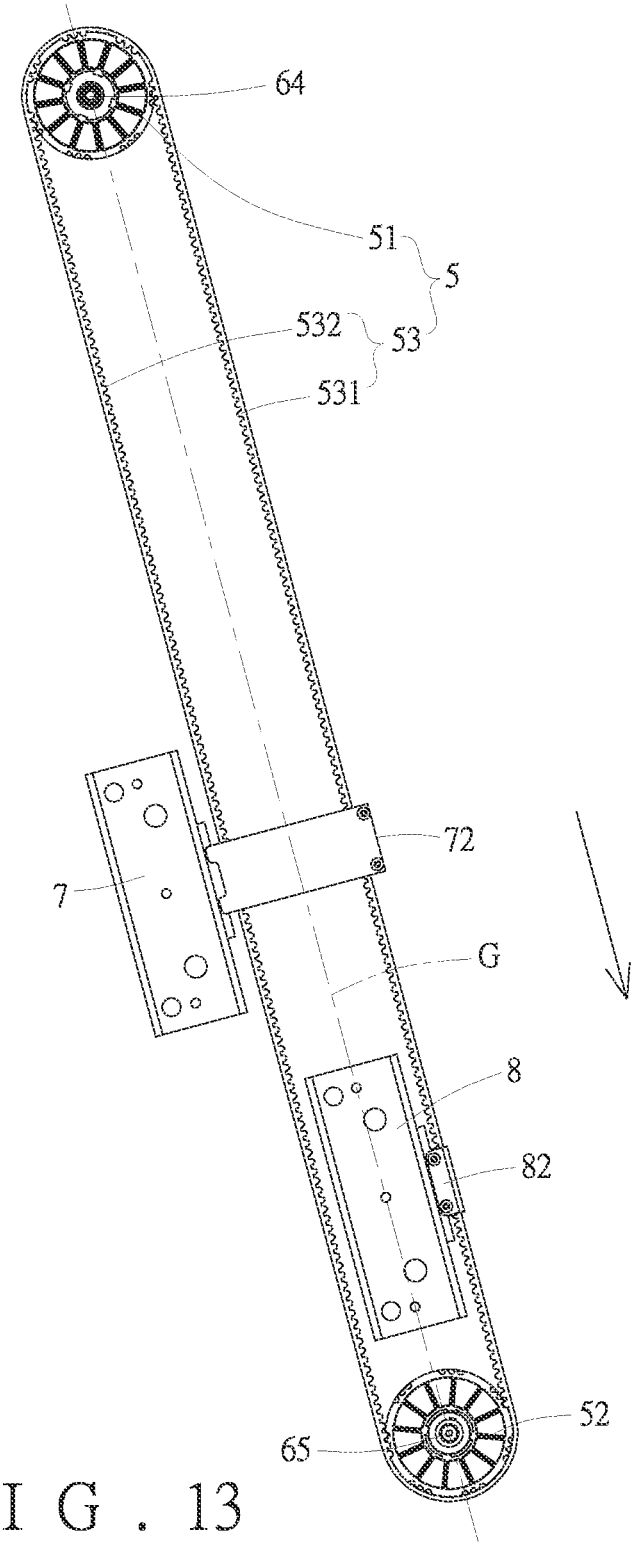
FIG. 13 is a simple schematic view of the connective positions of the first handle slider and the first footplate slider according to a second embodiment of the present invention.
Figure 14:
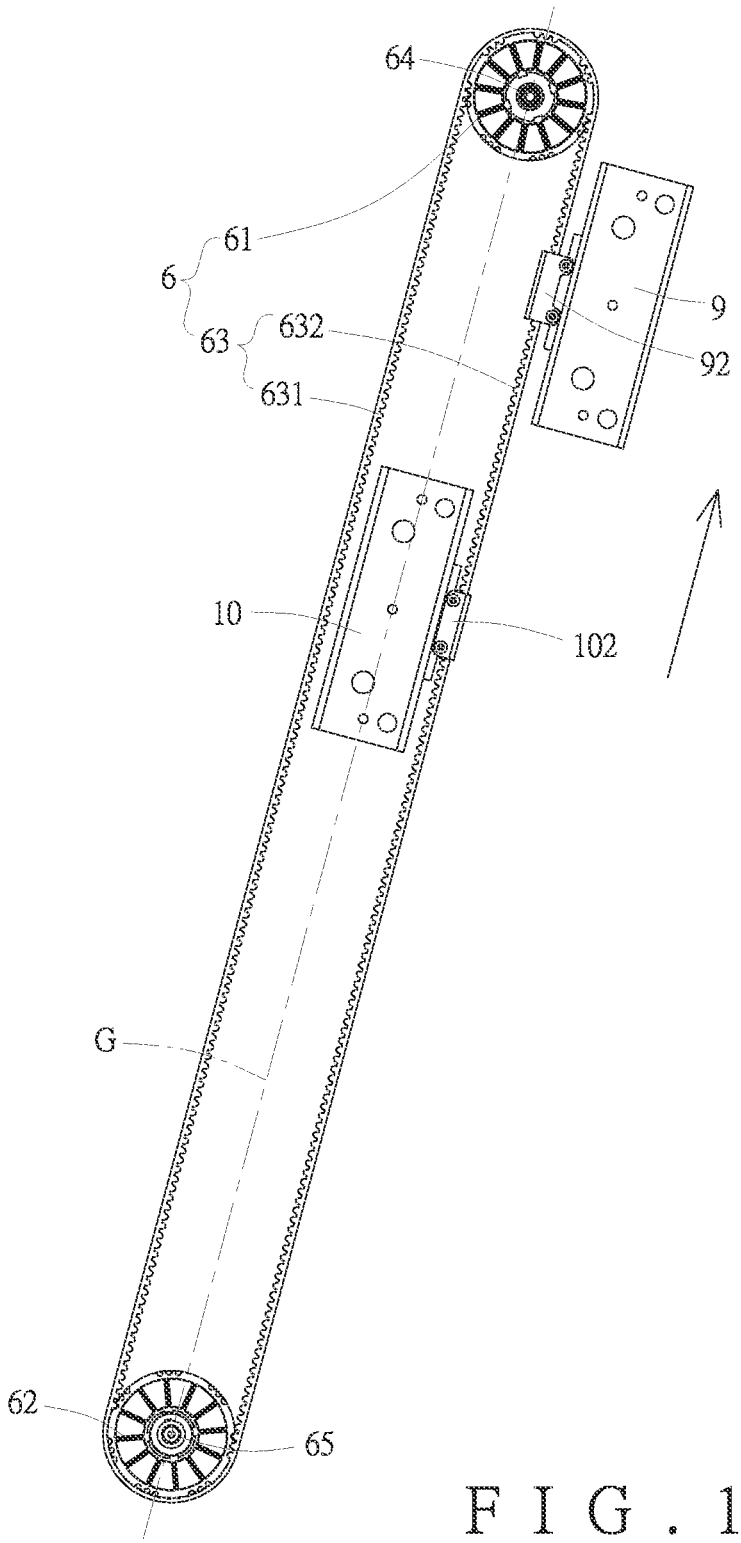
FIG. 14 is a simple schematic view of the connective positions of the second handle slider and the second footplate slider according to the second embodiment of the present invention.

Referring to FIG. 13 and FIG. 14, which show a second embodiment of the present invention, wherein the differences between the second embodiment and the above-described first embodiment lie in the first handle connecting piece 72 of the first handle slider 7 is connected to the first near section 531 of the first drive member 53, the first footplate connecting piece 82 of the first footplate slider 8 is connected to the first near section 531 of the first drive member 53, the second handle connecting piece 92 of the second handle slider 9 is connected to the second far section 632 of the second drive member 63, and the second footplate connecting piece 102 of the second footplate slider 10 is connected to the second far section 632 of the second drive member 63. The second embodiment of the present invention mainly connects the first footplate slider 8 and the second footplate slider 10, respectively, to any two of the first near section 531, the first far section 532, the second near section 631, and the second far section 632, at positions having opposite linear directions of motion (the first footplate slider 8 connects to the first near section 531, and the second footplate slider 10 connects to the second far section 632). The first handle slider 7 then connects to the first drive member 53, and is positioned at a second selected position (connects to the first near section 531) or the second drive member 63, wherein the direction of motion of the second selected position is the same as the direction of motion of the first footplate slider 8. Moreover, the second handle slider 9 connects to the first drive member 53, and is positioned at a fourth selected position (connects to the second far section 632) or the second drive member 63, wherein the direction of motion of the fourth selected position is the same as the direction of motion of the second footplate slider 10.

Referring to FIGS. 2, 3, 13, and 14, when the left foot of the operator F treads downward, the first near section 531 drives the first footplate slider 8 and the first handle slider 7 to synchronously displace downward (as shown by the solid arrow direction in FIG. 13). When the left foot and left hand of the operator F are synchronously displaced downward, because the first drive member 53 and the second drive member 63 synchronously rotate in the same direction, downward treading of the left foot of the operator F causes the second far section 632 to drive and synchronously upwardly displace the second handle slider 9 and the second footplate slider 10 (as shown by the solid arrow direction in FIG. 14). Alternate downward treading of the left foot and right foot of the operator F enables controlling upward and downward slide displacement of the left foot and left hand in the same direction, as well as upward and downward slide displacement of the right foot and right hand in the same direction, which is used to train synchronized and coordinated force application of the hands and feet to simulate actual rock climbing and mountaineering.

Figure 15:
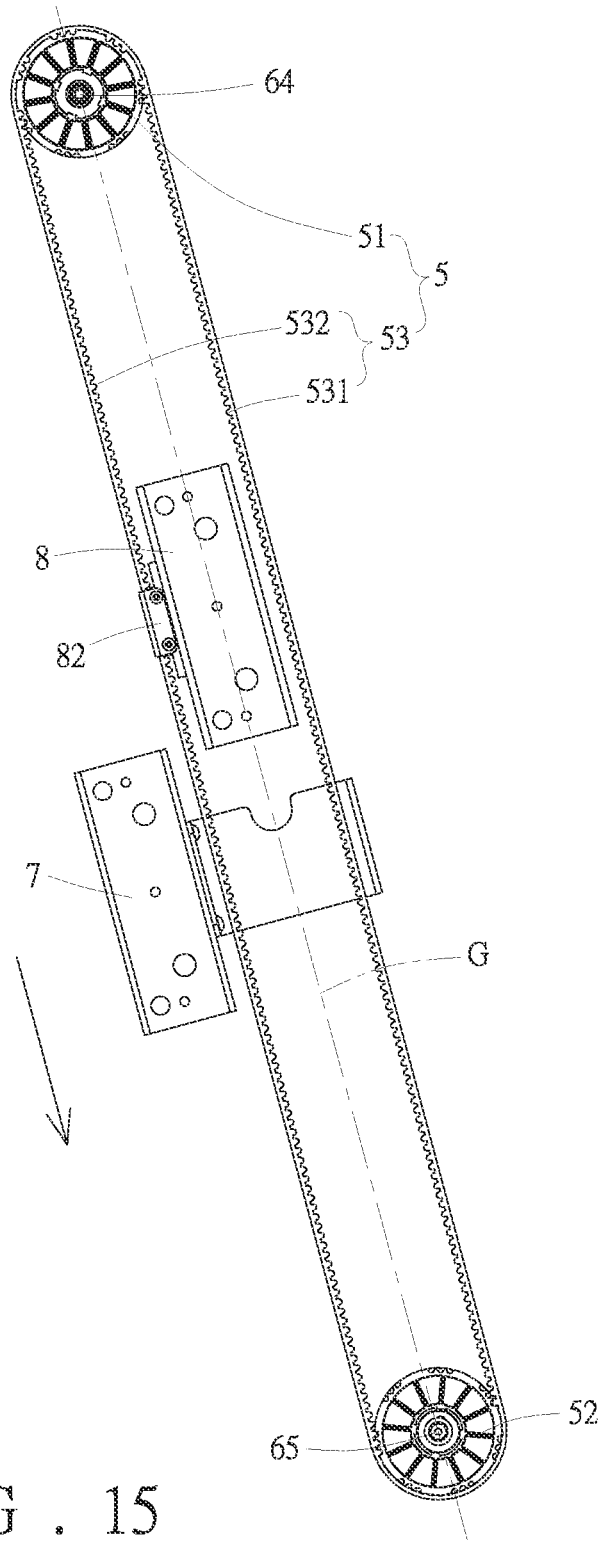
FIG. 15 is a simple schematic view of the connective positions of the first handle slider and the first footplate slider according to a third embodiment of the present invention.
Figure 16:
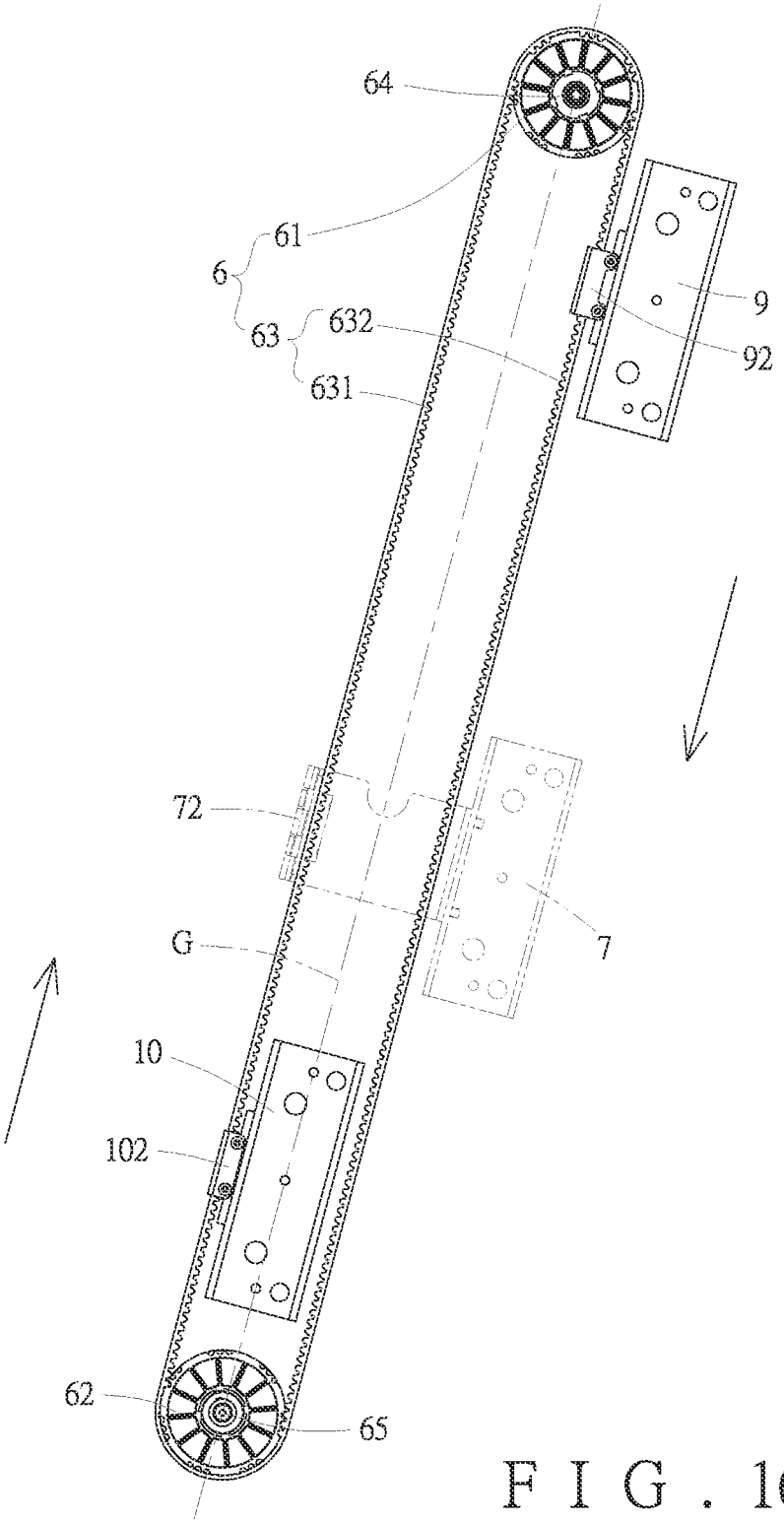
FIG. 16 is a simple schematic view of the connective positions of the second handle slider and the second footplate slider according to the third embodiment of the present invention.

Referring to FIG. 15 and FIG. 16, which show a third embodiment of the present invention, wherein the differences between the third embodiment and the above-described first embodiment lie in the first handle connecting piece 72 of the first handle slider 7 winds round to the second side 22 from the first side 21 of the support 2 and connects to the second near section 631 of the second drive member 63. The first footplate connecting piece 82 of the first footplate slider 8 connects to the first far section 532 of the first drive member 53, the second handle connecting piece 92 of the second handle slider 9 connects to the second far section 632 of the second drive member 63, and the second footplate connecting piece 102 of the second footplate slider 10 connects to the second near section 631 of the second drive member 63. The third embodiment of the present invention mainly connects the first footplate slider 8 and the second footplate slider 10, respectively, to any two of the first near section 531, the first far section 532, the second near section 631, and the second far section 632, at positions having opposite linear directions of motion (the first footplate slider 8 connects to the first far section 532, and the second footplate slider 10 connects to the second near section 631). The first handle slider 7 then connects to the first drive member 53, and is positioned at the first selected position (connects to the second near section 631) or the second drive member 63, wherein the direction of motion of the first selected position is opposite to the direction of motion of the first footplate slider 8. Moreover, the second handle slider 9 connects to the first drive member 53, and is positioned at the third selected position (connects to the second far section 632) or the second drive member 63, wherein the direction of motion of the third selected position is opposite to the direction of motion of the second footplate slider 10.

Referring to FIGS. 2, 3, 15, and 16, when the left foot of the operator F treads downward, the first far section 532 drives and downwardly displaces the first footplate slider 8 (as shown by the solid arrow direction in FIG. 15). Because the first drive member 53 and the second drive member 63 synchronously rotate in the same direction, downward treading of the left foot of the operator F causes the second near section 631 to drive and synchronously upwardly displace the first handle slider 7 and the second footplate slider 10 in the same direction (as shown by the solid arrow direction in FIG. 16), and the second far section 632 drives and synchronously downwardly displaces the second handle slider 9 corresponding to the same direction as the first footplate slider 8. Alternate synchronous downward treading of the left foot and right foot of the operator F enables controlling upward and downward slide displacement of the left foot and right hand in the same direction, as well as upward and downward slide displacement of the right foot and left hand in the same direction, which is used to train synchronized and coordinated force application of the hands and feet to simulate actual rock climbing and mountaineering.

Figure 17:
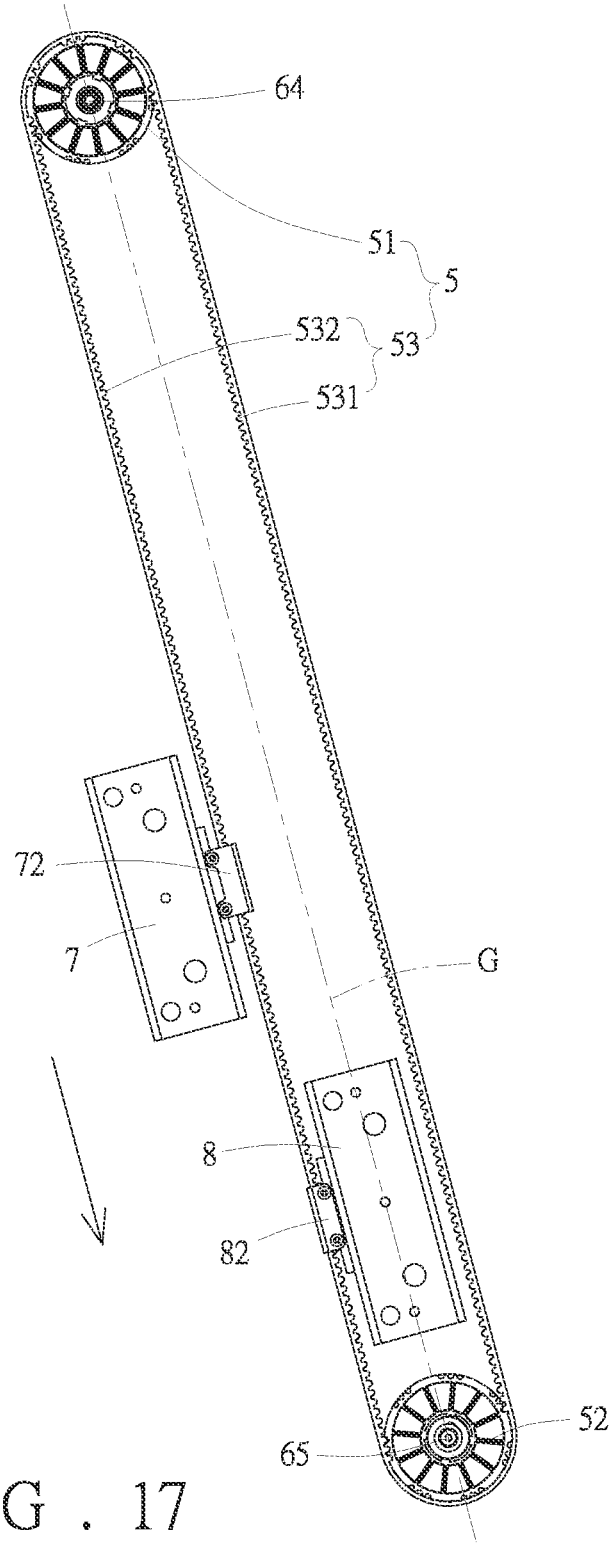
FIG. 17 is a simple schematic view of the connective positions of the first handle slider and the first footplate slider according to a fourth embodiment of the present invention.
Figure 18:
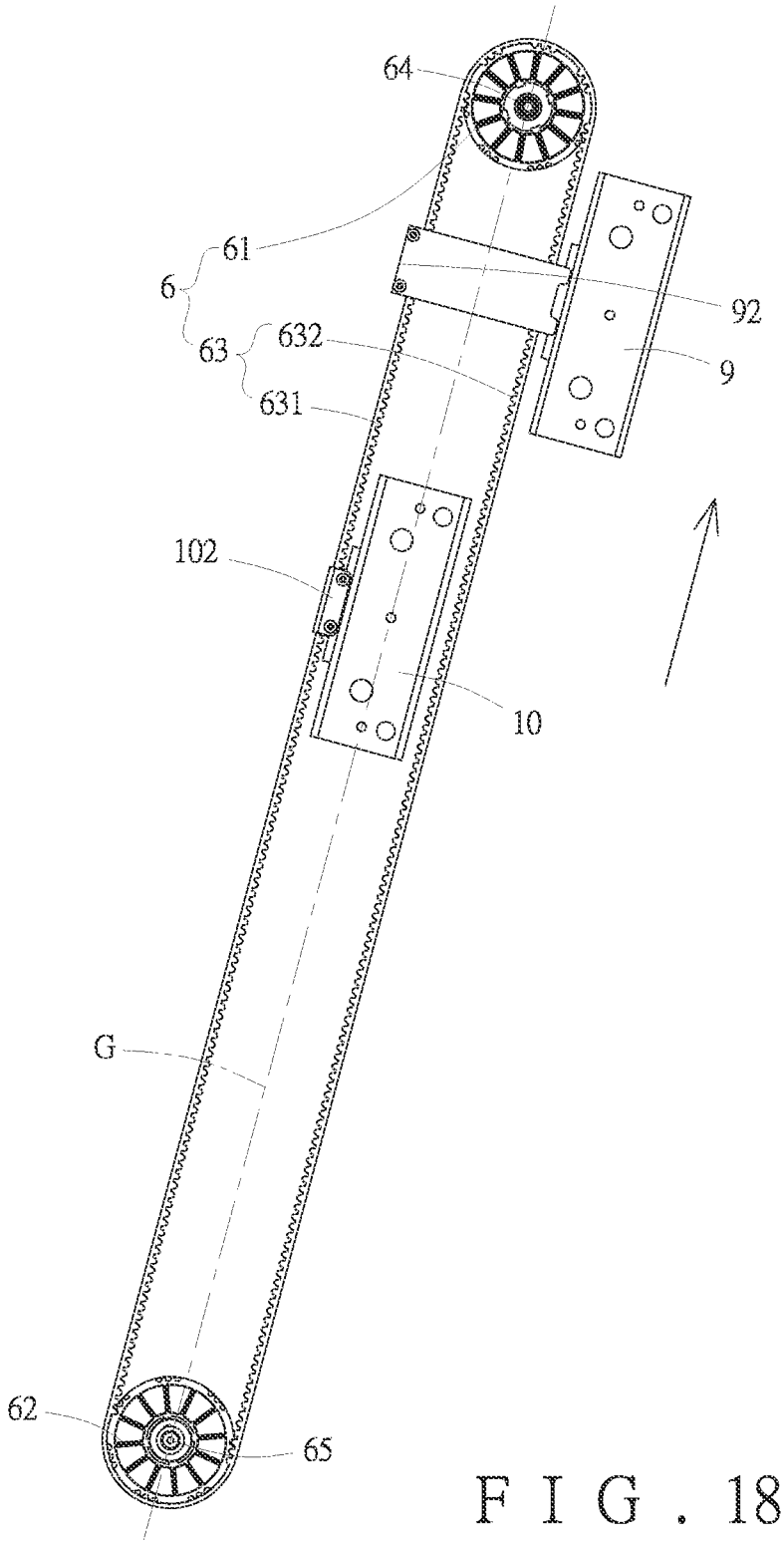
FIG. 18 is a simple schematic view of the connective positions of the second handle slider and the second footplate slider according to the fourth embodiment of the present invention.

Referring to FIG. 17 and FIG. 18, which show a fourth embodiment of the present invention, wherein the differences between the fourth embodiment and the above-described first embodiment lie in the first handle connecting piece 72 of the first handle slider 7 is connected to the first far section 532 of the first drive member 53, the first footplate connecting piece 82 of the first footplate slider 8 is connected to the first far section 532 of the first drive member 53, the second handle connecting piece 92 of the second handle slider 9 is connected to the second near section 631 of the second drive member 63, and the second footplate connecting piece 102 of the second footplate slider 10 is connected to the second near section 631 of the second drive member 63. The fourth embodiment of the present invention mainly connects the first footplate slider 8 and the second footplate slider 10, respectively, to any two of the first near section 531, the first far section 532, the second near section 631, and the second far section 632, at positions having opposite linear directions of motion (the first footplate slider 8 connects to the first far section 532, and the second footplate slider 10 connects to the second near section 631). The first handle slider 7 then connects to the first drive member 53, and is positioned at the second selected position (connects to the first far section 532) or the second drive member 63, wherein the direction of motion of the second selected position is opposite to the direction of motion of the first footplate slider 8. Moreover, the second handle slider 9 connects to the first drive member 53, and is positioned at the fourth selected position, or the second drive member 63 (connects to the second near section 631), wherein the direction of motion of the fourth selected position is the same as the direction of motion of the second footplate slider 10.

Referring to FIGS. 2, 3, 17, and 18, when the left foot of the operator F treads downward, the first far section 532 drives and synchronously displaces downward the first footplate slider 8 and the first handle slider 7 (as shown by the solid arrow direction in FIG. 17). When the left foot and left hand of the operator F are synchronously displaced downward in the same direction, because the first drive member 53 and the second drive member 63 synchronously rotate in the same direction, downward treading of the left foot of the operator F causes the second near section 631 to drive and synchronously upwardly displace the second handle slider 9 and the second footplate slider 10 in the same direction (as shown by the solid arrow direction in FIG. 18). Alternate downward treading of the left foot and right foot of the operator F enables controlling upward and downward slide displacement of the left foot and left hand in the same direction, as well as upward and downward slide displacement of the right foot and right hand in the same direction, which is used to train synchronized and coordinated force application of the hands and feet to simulate actual rock climbing and mountaineering.

Figure 19:
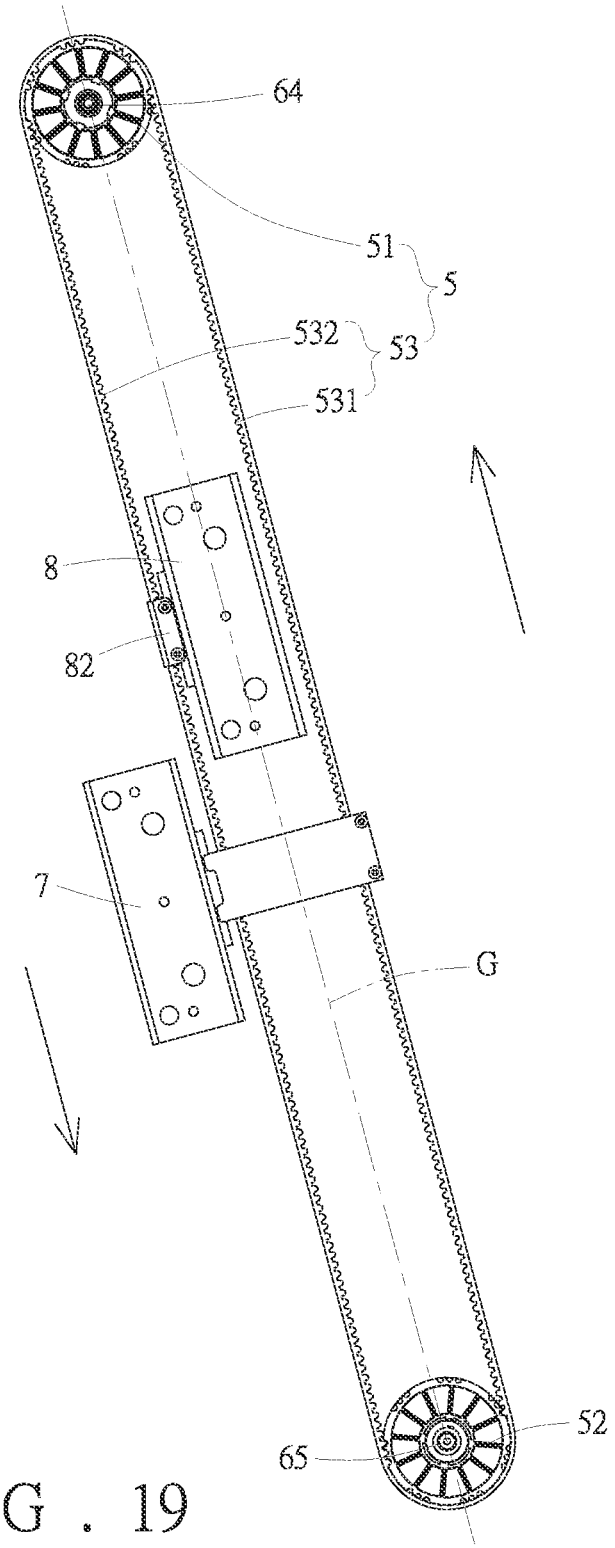
FIG. 19 is a simple schematic view of the connective positions of the first handle slider and the first footplate slider according to a fifth embodiment of the present invention.
Figure 20:
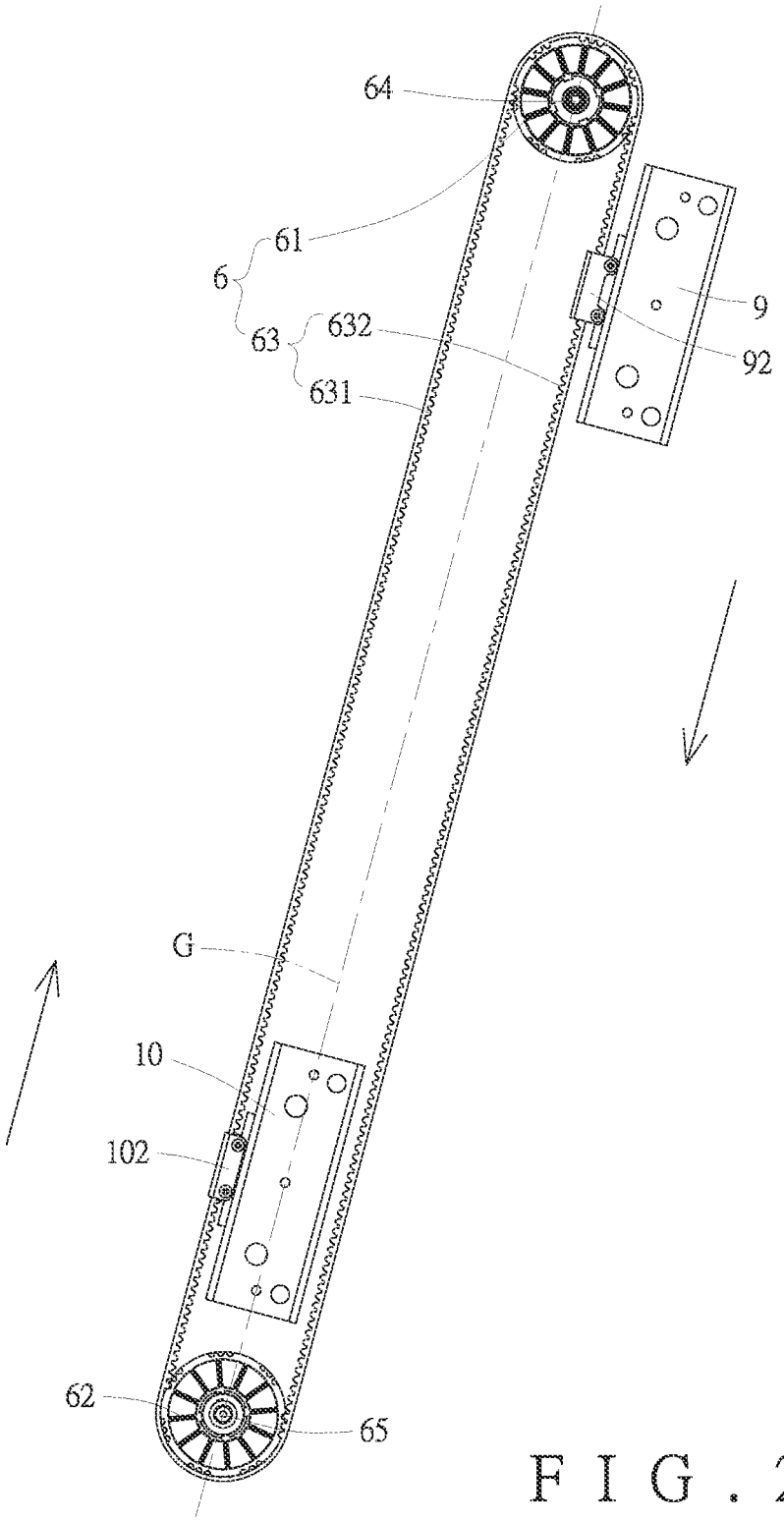
FIG. 20 is a simple schematic view of the connective positions of the second handle slider and the second footplate slider according to the fifth embodiment of the present invention.

Referring to FIG. 19 and FIG. 20, which show a fifth embodiment of the present invention, wherein the differences between the fifth embodiment of the present invention and the above-described first embodiment lie in the first handle connecting piece 72 of the first handle slider 7 is connected to the first near section 531 of the first drive member 53, the first footplate connecting piece 82 of the first footplate slider 8 is connected to the first far section 532 of the first drive member 53, the second handle connecting piece 92 of the second handle slider 9 is connected to the second far section 632 of the second drive member 63, and the second footplate connecting piece 102 of the second footplate slider 10 is connected to the second near section 631 of the second drive member 63. The fifth embodiment of the present invention mainly connects the first footplate slider 8 and the second footplate slider 10, respectively, to any two of the first near section 531, the first far section 532, the second near section 631, and the second far section 632, at positions having opposite linear directions of motion (the first footplate slider 8 connects to the first far section 532, and the second footplate slider 10 connects to the second near section 631). The first handle slider 7 then connects to the first drive member 53, and is positioned at the first selected position (connects to the first near section 531) or the second drive member 63, wherein the direction of motion of the first selected position is opposite to the direction of motion of the first footplate slider 8. Moreover, the second handle slider 9 connects to the first drive member 53, and is positioned at the third selected position (connects to the second far section 632) or the second drive member 63, wherein the direction of motion of the third selected position is opposite to the direction of motion of the second footplate slider 10.

Referring to FIGS. 2, 3, 19, and 20, when the left foot of the operator F treads downward, the first far section 532 drives and downwardly displaces the first footplate slider 8 (as shown by the solid arrow direction in FIG. 19), and the upward displacement of the first near section 531 synchronously drives and displaces the first handle slider 7 in the opposite direction. Because the first drive member 53 and the second drive member 63 synchronously rotate in the same direction, when the left foot of the operator F treads downward, upward displacement of the second near section 631 synchronously drives and displaces the second footplate slider 10 in the opposite direction (as shown by the solid arrow direction in FIG. 20), and the second far section 632 drives and synchronously downwardly displaces the second handle slider 9 corresponding to the same direction as the first footplate slider 8; that is, the left foot and right hand of the operator F are synchronously displaced downward in the same direction. Alternate downward treading of the left foot and right foot of the operator F enables controlling upward and downward slide displacement of the left foot and right hand in the same direction, as well as upward and downward slide displacement of the right foot and left hand in the same direction, which is used to train synchronized and coordinated force application of the hands and feet to simulate actual rock climbing and mountaineering.

Accordingly, the present invention does not need to change any transmission mechanism, and during production, and needs only to select to connect the first footplate slider 8 and the second footplate slider 10, respectively, to any two of the first near section 531, the first far section 532, the second near section 631, and the second far section 632, at positions having opposite linear directions of motion . The first handle slider 7 then connects to the first selected position so that the direction of motion thereof is opposite to the direction of motion of the first footplate slider 8, and connect the second handle slider 9 to the third selected position so that the direction of motion thereof is opposite to the direction of motion of the second footplate slider 10, or connect the first handle slider 7 to the second selected position so that the direction of motion thereof is the same as the direction of motion of the first footplate slider 8, and connect the second handle slider 9 to the fourth selected position so that the direction of motion thereof is the same as the direction of motion of the second footplate slider 10. In such a way, under the prerequisite that the left foot and right foot of the operator carry out alternate reverse treading throughout the exercise routine, the climber apparatus of the present invention can be easily altered to achieve different training modes, including upward and downward slide displacement of the left foot and right hand in the same direction, and upward and downward slide displacement of the right foot and left hand in the same direction; or upward and downward slide displacement of the left foot and left hand in the same direction, and upward and downward slide displacement of the right foot and right hand in the same direction.

In conclusion, from the description of the above embodiments, the operation and use of the present invention as well as the effects achieved can be clearly understood. It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A transmission structure for changing sliding direction of a climber apparatus, capable of enabling an operator to operate the climber apparatus in an upright position, comprising:

a base;

a support, which is vertically positioned on the base, the support is configured to be positioned between legs of the operator and has a first side and a second side;

a first slide rail, which is mounted on the first side;

a second slide rail, which is mounted on the second side;

a first transmission unit, including a first drive member, which is mounted to loop the first side, the first drive member includes a first near section and a first far section, the linear directions of motion of which are opposite;

a second transmission unit, including a second drive member, which is mounted to loop the second side, the second drive member includes a second near section and a second far section, the linear directions of motion of which are opposite, wherein the second transmission unit and the first transmission unit are in synchronized motion;

a first handle slider, which is fixed to a first handle, the first handle slider sliding in the first slide rail;

a first footplate slider, which is fixed to a first footplate, the first footplate slider sliding in the first slide rail;

a second handle slider, which is fixed to a second handle, the second handle slider sliding in the second slide rail;

a second footplate slider, which is fixed to a second footplate, the second footplate slider sliding in the second slide rail;

a resistance unit, which is mounted on the base or/and the support, the resistance unit being connected to the first transmission unit or/and the second transmission unit and providing a resistance force to the first transmission unit or/and the second transmission unit;

the first footplate slider and the second footplate slider are connected, respectively, to the first near section and the second far section;

the first handle slider connects to the first drive member, and is positioned at a first selected position, and the directions of motion of the first selected position and the first footplate slider are opposite, moreover, the second handle slider connects to the first drive member, and is positioned at a third selected position, and the directions of motion of the third selected position and the second footplate slider are opposite.

2. The transmission structure for changing sliding direction of a climber apparatus according to claim 1, wherein the first transmission unit further includes a first upper driving wheel and a first lower driving wheel, the first upper driving wheel is mounted on one end of the support, and the first lower driving wheel is mounted on the other end of the support;

the first drive member is mounted between the first upper driving wheel and the first lower driving wheel; and the second transmission unit further includes a second upper driving wheel and a second lower driving wheel, the second upper driving wheel is mounted on one end of the support corresponding to the first upper driving wheel, and the second lower driving wheel is mounted on the other end of the support corresponding to the first lower driving wheel, the second drive member is mounted between the second upper driving wheel and the second lower driving wheel.

3. The transmission structure for changing sliding direction of a climber apparatus according to claim 2, wherein the first upper driving wheel and the second upper driving wheel are joined to at least one upper spindle, and the at least one upper spindle is joined to the support; the first upper driving wheel and the second upper driving wheel each are disposed on the at least one upper spindle and rotatable back and forth; the first lower driving wheel and the second lower driving wheel are commonly joined to a lower spindle, and the lower spindle is disposed on the support and rotatable back and forth, thereby enabling the first lower driving wheel and the second lower driving wheel to synchronously rotate back and forth.

4. The transmission structure for changing sliding direction of a climber apparatus according to claim 3, wherein a connecting line between an upper spindle axis of the at least one upper spindle and a lower spindle axis of the lower spindle divides the first drive member into the first near section and the first far section, and the connecting line further divides the second drive member into the second near section and the second far section.

5. The transmission structure for changing sliding direction of a climber apparatus according to claim 3, wherein the resistance unit includes a driving wheel, a driven wheel, a resistance wheel, a magnetic resistance member, a first belt, and a second belt, wherein the driving wheel is fixed to the lower spindle, and rotates back and forth along in synchrony with the lower spindle, the driven wheel and the resistance wheel are correspondingly fixed to the base; the first belt is mounted between the driving wheel and the driven wheel, the second belt is mounted between the driven wheel and the resistance wheel, and the magnetic resistance member is mounted to rotate on the support, to enable exerting a resistance force on the resistance wheel, as well as enabling the resistance wheel to transmit a resistance force through the second belt, the driven wheel, the first belt, and the driving wheel; the resistance force is also transmitted to the first handle, the first footplate, the second handle, and the second footplate through the first drive member and the second drive member.

6. The transmission structure for changing sliding direction of a climber apparatus according to claim 2, wherein the first upper driving wheel and the second upper driving wheel are coaxially mounted on one end of the support, and the first lower driving wheel and the second lower driving wheel are coaxially mounted on the other end of the support.

7. The transmission structure for changing sliding direction of a climber apparatus according to claim 1, wherein the first slide rail includes a first near slide rail and a first far slide rail, the first near slide rail is configured to the support close to the position of the operator, and the first footplate slider slides in the first near slide rail; the first far slide rail is configured to the support at a distance from the position of the operator, and the first handle slider slides in the first far slide rail; the second slide rail includes a second near slide rail and a second far slide rail, the second near slide rail is configured to the support close to the position of the operator, and the second footplate slider slides in the second near slide rail; the second far slide rail is configured to the support at a distance from the position of the operator, and the second handle slider slides in the second far slide rail.

8. The transmission structure for changing sliding direction of a climber apparatus according to claim 1, wherein the first footplate slider is configured with a first footplate connecting piece that connects to the first drive member, the first handle slider is configured with a first handle connecting piece that connects to the first drive member, the second footplate slider is configured with a second footplate connecting piece that connects to the second drive member, the second handle slider is configured with a second handle connecting piece that connects to the first drive member.

9. The transmission structure for changing sliding direction of a climber apparatus according to claim 1, wherein the support is configured with an auxiliary frame at a distance from one end of the base, the auxiliary frame is configured with an auxiliary handle adjacent to the position of the operator, the auxiliary frame is configured with a display unit at a distance from the position of the operator; the first handle is provided with a first handle upper section, the second handle is provided with a second handle upper section, and the distance between the first handle upper section and the second handle upper section is greater than a width of the display unit.

* * * * *